US011018414B2

(12) United States Patent
Sung et al.

(10) Patent No.: US 11,018,414 B2
(45) Date of Patent: May 25, 2021

(54) ELECTRONIC DEVICE COMPRISING ANTENNA

(71) Applicant: Samsung Electronics Co., Ltd., Gyeonggi-do (KR)

(72) Inventors: Sang Bong Sung, Gyeonggi-do (KR); Se Woong Kim, Gyeongsangnam-do (KR); Tae Young Kim, Gyeonggi-do (KR); In Young Lee, Gyeonggi-do (KR)

(73) Assignee: Samsung Electronics Co., Ltd

( * ) Notice: Subject to any disclaimer, the term of this patent is extended or adjusted under 35 U.S.C. 154(b) by 784 days.

(21) Appl. No.: 15/612,669

(22) Filed: Jun. 2, 2017

(65) Prior Publication Data

US 2017/0352943 A1 Dec. 7, 2017

(30) Foreign Application Priority Data

Jun. 2, 2016 (KR) ..... 10-2016-0068646

(51) Int. Cl.
*H01Q 1/24* (2006.01)
*H01Q 1/27* (2006.01)
(Continued)

(52) U.S. Cl.
CPC ..... *H01Q 1/243* (2013.01); *H01Q 1/245* (2013.01); *H01Q 1/273* (2013.01);
(Continued)

(58) Field of Classification Search
CPC ... H01Q 1/242–245; H01Q 1/32–3291; G07C 9/00944
See application file for complete search history.

(56) References Cited

U.S. PATENT DOCUMENTS 6,380,900 B1 * 4/2002 Kanayama ..... H01Q 1/243 343/702
6,642,893 B1 * 11/2003 Hebron ..... H01Q 1/244 343/702

(Continued)

FOREIGN PATENT DOCUMENTS

JP 2011-151658 8/2011
JP 2012-199687 10/2012
WO WO 2015/128856 9/2015

OTHER PUBLICATIONS

European Search Report Search Report dated Mar. 4, 2019 issued in counterpart application No. 17806935.7-1205, 12 pages.

(Continued)

*Primary Examiner* — Graham P Smith
*Assistant Examiner* — Amal Patel
(74) *Attorney, Agent, or Firm* — The Farrell Law Firm, P.C.

(57) ABSTRACT

An electronic device is provided. The electronic device includes a housing, a first antenna radiator configured to transmit a signal having a target frequency to a vehicle and exposed to an outside of the housing, a second antenna radiator spaced apart from the first antenna radiator, configured to transmit the signal having the target frequency to the vehicle, and exposed to the outside of the housing, a conductive line disposed in an interior of the housing and electrically connecting the first antenna radiator and the second antenna radiator, and a feeding part configured to supply power to one point of the conductive line, wherein a first electrical length formed by the feeding part, the one point of the conductive line, and the first antenna radiator is different from a second electrical length formed by the feeding part, the one point of the conductive line, and the second antenna radiator.

9 Claims, 14 Drawing Sheets

(51) Int. Cl.

| | |
|---|---|
| ***H01Q 5/371*** | (2015.01) |
| ***H01Q 21/30*** | (2006.01) |
| ***H01Q 1/32*** | (2006.01) |
| ***H01Q 9/42*** | (2006.01) |
| ***G07C 9/00*** | (2020.01) |

(52) U.S. Cl.

CPC ..... *H01Q 1/3241* (2013.01); *H01Q 5/371* (2015.01); *H01Q 21/30* (2013.01); *G07C 2009/00769* (2013.01); *H01Q 9/42* (2013.01)

(56) References Cited

U.S. PATENT DOCUMENTS

| | | | | |
|---|---|---|---|---|
| 8,531,337 | B2 | 9/2013 | Soler Castany et al. | |
| 8,610,635 | B2 | 12/2013 | Huang et al. | |
| 8,841,882 | B2 | 9/2014 | Sato | |
| 9,209,849 | B2 | 12/2015 | Kim et al. | |
| 10,396,443 | B2 * | 8/2019 | Spall | H01Q 21/30 |
| 2005/0264458 | A1 | 12/2005 | Takagi et al. | |
| 2006/0001770 | A1 * | 1/2006 | Kang | G08C 17/00 348/552 |
| 2008/0198082 | A1 | 8/2008 | Soler Castany et al. | |
| 2009/0091504 | A1 * | 4/2009 | Licul | H01Q 1/521 343/718 |
| 2010/0225554 | A1 | 9/2010 | Huang et al. | |
| 2011/0065429 | A1 | 3/2011 | Kim et al. | |
| 2012/0235635 | A1 | 9/2012 | Sato | |
| 2014/0292590 | A1 | 10/2014 | Yoo et al. | |
| 2014/0320367 | A1 * | 10/2014 | Alkhateeb | H01Q 1/38 343/804 |
| 2014/0327585 | A1 | 11/2014 | Sato | |
| 2016/0365622 | A1 | 12/2016 | Na et al. | |

OTHER PUBLICATIONS

International Search Report dated Aug. 30, 2017 issued in counterpart application No. PCT/KR2017/005452, 11 pages.

* cited by examiner

ELECTRONIC DEVICE COMPRISING ANTENNA

PRIORITY

This application claims priority under 35 U.S.C. § 119(a) to a Korean Patent Application filed on Jun. 2, 2016 in the Korean Intellectual Property Office and assigned Serial number 10-2016-0068646, the entire disclosure of which is incorporated herein by reference.

BACKGROUND

1. Field of the Disclosure

The present disclosure relates generally to an electronic device for transmitting and receiving a signal of a certain frequency by using a plurality of antennas, and more particularly, to an electronic device including an antenna for communicating with a vehicle to reduce the influence of an external object and to increase the communication distance.

2. Description of the Related Art

To cope with the recent trend of digital convergence, a key for a vehicle is evolving into a smart device that is capable of providing various functions. For example, a recent vehicle key may be used to lock or unlock a door, start a vehicle, control an air-conditioning and heating system, and the like and may output a variety of information about the vehicle by using a display included in the vehicle key. Alternatively, the above-described functions may be performed by a mobile device (e.g., a smartphone or a tablet personal computer (PC)) or a wearable device (e.g., a smart watch) that is operated in association with a vehicle.

To perform the above-described functions, communication may be performed between a vehicle and an electronic device such as a vehicle key, a mobile device, a wearable device, or the like. An electronic device may include an antenna used for communicating with the vehicle.

The performance of an antenna included in an electronic device may decrease due to the influence of a hand of a user when using the electronic device. For example, communication with a vehicle may be performed at a frequency of about 300 MHz to about 450 MHz. Accordingly, a length of an antenna for communicating with a vehicle may be greater than a length of an antenna for cellular communication, and a user's hand may have a greater influence on the performance of the antenna for communicating with the vehicle due to a relatively greater length of the antenna.

SUMMARY

An aspect of the present disclosure is to provide an electronic device including an antenna structure that is capable of smoothly communicating with a vehicle to reduce the influence of an external object and increase the communication distance.

In accordance with an aspect of the present disclosure, an electronic device which controls a vehicle wirelessly is provided. The electronic device includes a housing, a first antenna radiator configured to transmit a signal having a target frequency to the vehicle and exposed to an outside of the housing, a second antenna radiator spaced apart from the first antenna radiator, configured to transmit the signal having the target frequency to the vehicle, and exposed to the outside of the housing, a conductive line disposed in an interior of the housing and electrically connecting the first antenna radiator and the second antenna radiator, and a feeding part configured to supply power to one point of the conductive line, wherein a first electrical length formed by the feeding part, the one point of the conductive line, and the first antenna radiator is different from a second electrical length formed by the feeding part, the one point of the conductive line, and the second antenna radiator.

In accordance with another aspect of the present disclosure, a wearable electronic device which controls a vehicle wirelessly is provided. The electronic device includes a housing, a first strap connected to the housing, a second strap connected to the housing in a direction that is opposite to the first strap, a first antenna radiator configured to transmit a signal having a target frequency to the vehicle and disposed on an outside of the housing, a second antenna radiator configured to transmit the signal having the target frequency to a vehicle and disposed on the outside of the housing, a conductive line disposed in an interior of the housing and electrically connecting the first antenna radiator and the second antenna radiator, and a feeding part configured to supply power to one point of the conductive line, wherein a first electrical length formed by the feeding part, the one point of the conductive line, and the first antenna radiator is different from a second electrical length formed by the feeding part, the one point of the conductive line, and the second antenna radiator.

In accordance with another aspect of the present disclosure, an electronic device is provided. The electronic device includes a first antenna radiator, a second antenna radiator spaced apart from the first antenna radiator, a conductive line electrically connecting the first antenna radiator and the second antenna radiator, and a feeding part to supply power to one point of the conductive line, wherein a first electrical length formed by the feeding part, the one point of the conductive line, and the first antenna radiator is different from a second electrical length formed by the feeding part, the one point of the conductive line, and the second antenna radiator.

BRIEF DESCRIPTION OF THE DRAWINGS

The above and other aspects, features, and advantages of the present disclosure will be more apparent from the following detailed description, taken in conjunction with the accompanying drawings, in which.

DETAILED DESCRIPTION OF EMBODIMENTS OF THE PRESENT DISCLOSURE

Figure 1:
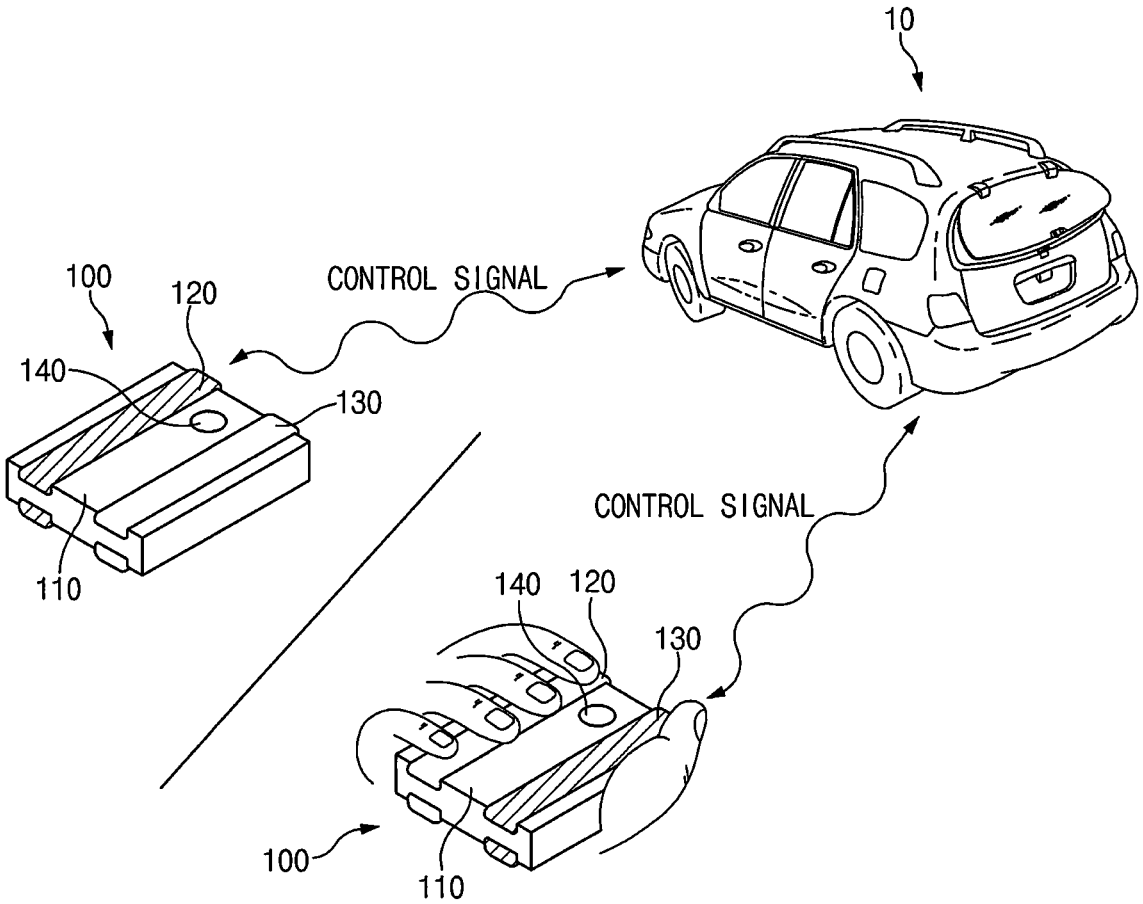
FIG. 1 illustrates an environment in which an electronic device operates, according to an embodiment of the present disclosure.

Hereinafter, various embodiments of the present disclosure are described with reference to the accompanying drawings. Accordingly, those of ordinary skill in the art will recognize that a modification, an equivalent, and/or an alternative of the various embodiments described herein may be variously made without departing from the scope and spirit of the present disclosure. With regard to the description of drawings, similar elements may be marked with similar reference numerals.

In the present disclosure, the expressions "have", "may have", "include", "comprise", "may include" and "may comprise" used herein indicate the existence of corresponding features (e.g., elements such as numerical values, functions, operations, or components) but do not exclude the presence of additional features.

In the present disclosure, the expressions "A or B", "at least one of A and/or B", "one or more of A and/or B", and the like may include any and all combinations of one or more of the associated listed items. For example, the expressions "A or B", "at least one of A and B", or "at least one of A or B" may refer to all of the case (1) where at least one A is included, the case (2) where at least one B is included, or the case (3) where both of at least one A and at least one B are included.

The terms "first", "second", and the like used in the present disclosure may be used to refer to various elements regardless of the order and/or the priority and to distinguish the relevant elements from other elements, but are not intended to limit the elements. For example, "a first user device" and "a second user device" indicate different user devices regardless of the order or priority. For example, without departing from the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there is no intervening element (e.g., a third element).

According to the situation, the expression "configured to" used in the present disclosure may be interchangeably used with, for example, the expressions "suitable for", "having the capacity to", "designed to", "adapted to", "made to", or "capable of". The term "configured to" is not intended to indicate only "specifically designed to" in hardware. Instead, the expression "a device configured to" may indicate that the device is "capable of" operating together with another device or other components. For example, a "processor configured to (or set to) perform A, B, and C" may indicate a dedicated processor (e.g., an embedded processor) for performing a corresponding operation or a general purpose processor (e.g., a central processing unit (CPU) or an application processor (AP)) which performs corresponding operations by executing one or more software programs which are stored in a memory device.

Terms used in the present disclosure are used to describe certain embodiments but are not intended to limit the scope of the present disclosure. The terms of a singular form may include plural forms unless otherwise specified. All the terms used herein, may have the same meanings that are generally understood by a person skilled in the art. It will be further understood that terms, which are defined in a dictionary and commonly used, should also be interpreted as is customary in the relevant related art and not in an idealized or overly formal manner unless expressly so defined in an embodiment of the present disclosure. For example, even terms defined in the present disclosure are not intended to be interpreted to exclude embodiments of the present disclosure.

An electronic device according to various embodiments of the present disclosure may include at least one of, for example, smartphones, tablet PCs, mobile phones, video telephones, electronic book readers, desktop PCs, laptop PCs, netbook computers, workstations, servers, personal digital assistants (PDAs), portable multimedia players (PMPs), moving picture experts group (MPEG-1 or MPEG-2) audio layer 3 (MP3) players, mobile medical devices, cameras, or wearable devices. According to various embodiments of the present disclosure, a wearable device may include at least one of an accessory type (e.g., watches, rings, bracelets, anklets, necklaces, glasses, contact lens, or head-mounted-devices (HMDs), a fabric or garment-integrated type (e.g., an electronic apparel), a body-attached type (e.g., a skin pad or tattoos), or a bio-implantable type (e.g., an implantable circuit).

According to various embodiments of the present disclosure, the electronic device may be a home appliance. The home appliances may include at least one of, for example, televisions (TVs), digital versatile disc (DVD) players, audio players, refrigerators, air conditioners, cleaners, ovens, microwave ovens, washing machines, air cleaners, set-top boxes, home automation control panels, security control panels, TV boxes (e.g., Samsung HomeSync®, Apple TV®, or Google™), game consoles (e.g., Xbox® or PlayStation®), electronic dictionaries, electronic keys, camcorders, electronic picture frames, and the like.

According to another embodiment of the present disclosure, an electronic device may include at least one of various medical devices (e.g., various portable medical measurement devices (e.g., a blood glucose monitoring device, a heartbeat measuring device, a blood pressure measuring device, a body temperature measuring device, and the like), a magnetic resonance angiography (MRA) device, a magnetic resonance imaging (MRI) device, a computed tomography (CT) device, scanners, and ultrasonic devices), navigation devices, Global Navigation Satellite System (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automated teller machines (ATMs), points of sales (POSs) devices of stores, or an Internet of Things (IoT) device (e.g., light bulbs, various sensors, electric or gas meters, sprinkler devices, fire alarms, thermostats, street lamps, toasters, exercise equipment, hot water tanks, heaters, boilers, and the like).

According to an embodiment of the present disclosure, the electronic device may include at least one of parts of furniture or buildings/structures, electronic boards, electronic signature receiving devices, projectors, or various measuring instruments (e.g., water meters, electricity meters, gas meters, wave meters, and the like). An electronic device may be one of the above-described devices or a combination thereof. An electronic device may be a flexible electronic device. Furthermore, an electronic device is not intended to be limited to the above-described electronic devices but may include other electronic devices and new electronic devices to be developed.

Hereinafter, electronic devices according to various embodiments of the present disclosure are described with reference to the accompanying drawings. In the present disclosure, the term "user" may refer to a person who uses an electronic device or may refer to a device (e.g., an artificial intelligence electronic device) that uses the electronic device.

FIG. 1 illustrates an environment in which an electronic device operates, according to an embodiment of the present disclosure.

Referring to FIG. 1, an electronic device 100 may control an external device 10. For example, as illustrated in FIG. 1, the electronic device 100 may be a vehicle key, a mobile device such as a smartphone, a tablet PC, or the like, or a wearable device such as a smart watch. For example, the external device 10 may be a vehicle or may be one of various kinds of devices, which are controlled by the electronic device 100, such as appliances or the like.

According to an embodiment of the present disclosure, the electronic device 100 may include a housing 110, a first antenna radiator 120, a second antenna radiator 130, and a control button 140. If an input to the control button 140 is made by a user, the electronic device 100 may wirelessly transmit a control signal to the external device 10 by using the first antenna radiator 120 and/or the second antenna radiator 130 exposed to the outside of the housing 110. For example, the electronic device 100 may transmit a signal to the external device 10 to control a locking state of a door, a starting of a vehicle, an operation of an air-conditioning and heating system, an opening and shutting of a sun roof, and/or an opening and shutting of a window.

According to an embodiment of the present disclosure, the electronic device 100 may receive a signal from the external device 10 by using the first antenna radiator 120 and/or the second antenna radiator 130. For example, the electronic device 100 may receive, from the external device 10, a signal including information about a connection state between the electronic device 100 and the external device 10, a fuel level, a driving distance, whether an air-conditioning and heating system operates, and/or whether a door is opened or shut. A frequency of the control signal may be about 300 MHz to about 450 MHz.

A resonant frequency of the first antenna radiator 120 and the second antenna radiator 130 may be affected by a user's hand. For example, in the case where the first antenna radiator 120 and the second antenna radiator 130 are gripped by the user, the resonant frequency of the first antenna radiator 120 and the second antenna radiator 130 may be changed.

According to an embodiment of the present disclosure, in a case where the electronic device 100 is not gripped by a user, the first antenna radiator 120 may have a resonant frequency corresponding to a frequency of the control signal. For example, a resonant frequency of the first antenna radiator 120 may be about 300 MHz to about 450 MHz. Accordingly, if an input to the control button 140 is made while the electronic device 100 is not gripped by the user, the control signal may be transmitted mainly from the first antenna radiator 120 to the external device 10.

According to an embodiment of the present disclosure, in a case where the electronic device 100 is gripped by a user, the second antenna radiator 130 may have a resonant frequency corresponding to the frequency of the control signal. For example, a resonant frequency of the second antenna radiator 130 may be higher by a certain value than a resonant frequency of the first antenna radiator 120. Accordingly, if an input to the control button 140 is made while the electronic device 100 is gripped by the user, the control signal may be transmitted mainly from the second antenna radiator 130 to the external device 10.

The electronic device 100 according to various embodiments of the present disclosure may further include elements such as a display, a light emitting diode (LED), a speaker, and/or a microphone.

Figure 2A:
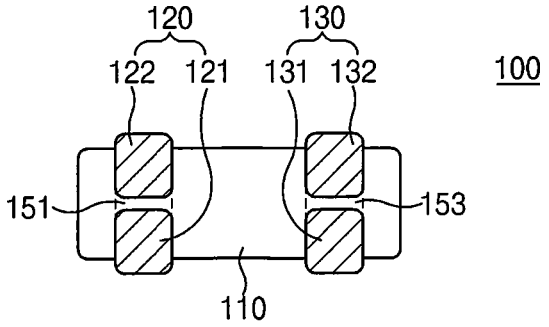
FIGS. 2A, 2B, and 2C illustrate top, front, and bottom views of an electronic device, according to an embodiment of the present disclosure.
Figure 2B:
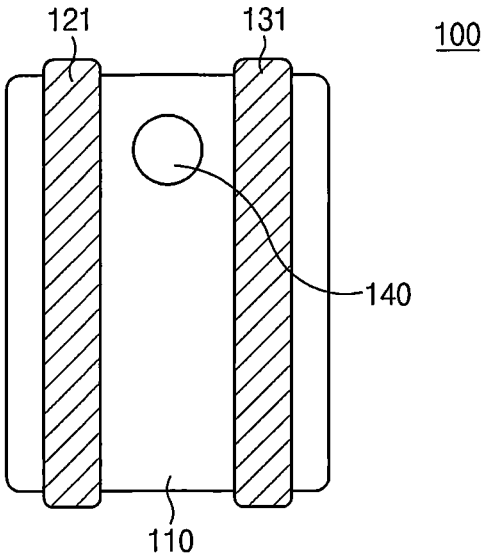
Figure 2C:
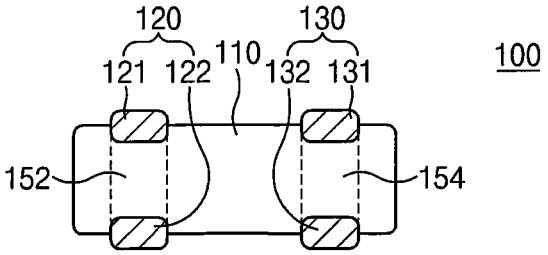

FIGS. 2A, 2B, and 2C illustrate top, front, and bottom views of an electronic device, according to an embodiment of the present disclosure.

Referring to FIGS. 2A, 2B, and 2C, the electronic device 100 according to an embodiment of the present disclosure may include a housing, the first antenna radiator 120, the second antenna radiator 130, and the control button 140. The electronic device 100 may be a vehicle key for controlling a vehicle wirelessly.

The housing may surround elements (e.g., a processor, a memory, and/or a communication circuit) of the electronic device 100. The housing is illustrated in FIGS. 2A, 2B, and 2C as having a shape of a cuboid. However, the present disclosure is not intended to be limited thereto. For example, the housing may have various shapes.

The first antenna radiator 120 may be exposed to the outside of the housing 110. The first antenna radiator 120 may be a metal frame that is exposed to the outside of the housing 110. The first antenna radiator 120 may be disposed from a front surface of the housing 110 to a rear surface of the housing 110 through a side surface of the housing 110. For example, the first antenna radiator 120 may have a C-shape such that the front surface, one side surface, and the rear surface of the housing 110 are surrounded.

The first antenna radiator 120 may include one or more conductive members. According to an embodiment of the present disclosure, the first antenna radiator 120 may include a first conductive member 121 and a second conductive member 122. The first conductive member 121 and the second conductive member 122 may be spaced apart from each other. For example, the first conductive member 121 and the second conductive member 122 may be spaced apart from each other in a first area 151 of an upper surface of the housing 110 and in a second area 152 of a lower surface of the housing 110. For example, the first conductive member 121 may be disposed to extend from a front surface of the housing 110 to a side surface of the housing 110, and the second conductive member 122 may be disposed to extend from a rear surface of the housing 110 to the side surface of the housing 110. The first conductive member 121 and the second conductive member 122 may not contact each other on the upper surface or the lower surface of the housing 110 but may be electrically coupled to each other. The first antenna radiator 120 is illustrated in FIGS. 2A, 2B, and 2C as including the first conductive member 121 and the second conductive member 122. However, the present disclosure is not limited thereto. For example, the first antenna radiator 120 may be implemented with one conductive member. For example, the first antenna radiator 120 may be formed in a C-shape in which the first area 151 is filled, a C-shape in which the second area 152 is filled, or a loop-shape in which the first area 151 and the second area 152 are each filled. In addition, the first conductive member 121 and the second conductive member 122 may be electrically connected to each other through another conductive member.

The first antenna radiator 120 may be configured to transmit a signal having a target frequency to an external device (e.g., the external device 10 of FIG. 1). In addition, the first antenna radiator 120 may be configured to receive a signal having the target frequency from the external device. The target frequency may be a frequency of a signal used for communication between the electronic device 100 and the external device. For example, the target frequency may be about 300 MHz to about 450 MHz. In detail, the target frequency may be about 315 MHz or about 433 MHz. According to an embodiment of the present disclosure, the first antenna radiator 120 may be designed to transmit and receive a signal having the target frequency (e.g., about 315 MHz or about 433 MHz) in a case where the first antenna radiator 120 does not make contact with an external object. A relationship between the first antenna radiator 120 and the external object is described below with reference to FIG. 4.

The second antenna radiator 130 may be exposed to the outside of the housing 110. The second antenna radiator 130 may be a metal frame that is exposed to the outside of the housing 110.

According to an embodiment of the present disclosure, the second antenna radiator 130 may be formed in the same shape as the first antenna radiator 120. For example, like the first antenna radiator 120, the second antenna radiator 130 may be disposed to extend from the front surface of the housing 110 to the rear surface of the housing 110 through the side surface of the housing 110 and may include a third conductive member 131 and a fourth conductive member 132. The third conductive member 131 and the fourth conductive member 132 may be formed in the same shape as the first conductive member 121 and the second conductive member 122, respectively. The third conductive member 131 and the fourth conductive member 132 may not contact each other on the upper surface or the lower surface of the housing 110 but may be electrically coupled to each other. The second antenna radiator 130 is illustrated in FIGS. 2A, 2B, and 2C as including the third conductive member 131 and the fourth conductive member 132 that are spaced apart from each other. However, the present disclosure is not limited thereto. For example, the second antenna radiator 130 may be implemented with one conductive member. For example, the second antenna radiator 130 may be formed in a C-shape in which a third area 153 is filled, a C-shape in which a fourth area 154 is filled, or a loop-shape in which the third area 153 and the fourth area 154 are all filled. In addition, the third conductive member 131 and the fourth conductive member 132 may be electrically connected to each other through another conductive member.

The second antenna radiator 130 may be disposed to be spaced apart from the first antenna radiator 120. According to an embodiment of the present disclosure, the second antenna radiator 130 may be disposed to be symmetrical to the first antenna radiator 120 in the electronic device 100. For example, in a case where the first antenna radiator 120 is disposed on a left side of the electronic device 100, the second antenna radiator 130 may be disposed on a right side of the electronic device 100 to be symmetrical to the first antenna radiator 120.

According to various embodiments of the present disclosure, a shape of the second antenna radiator 130 may be different from that of the first antenna radiator 120, the third conductive member 131 and the fourth conductive member 132 may be formed to be different in shape from the first conductive member 121 and the second conductive member 122. In addition, the second antenna radiator 130 may be disposed to be asymmetrical to the first antenna radiator 120.

The second antenna radiator 130 may be configured to transmit a signal having the target frequency to the external device. In addition, the second antenna radiator 130 may be configured to receive a signal having the target frequency from the external device. According to an embodiment of the present disclosure, the second antenna radiator 130 may be designed to transmit and receive a signal having the target frequency (e.g., about 315 MHz or about 433 MHz) in the case where the second antenna radiator 130 does not make contact with an external object. A relationship between the second antenna radiator 130 and the external object is described below with reference to FIG. 4.

The control button 140 may be exposed to the outside of the housing 110. In a case where the control button 140 is pushed by a user, the electronic device 100 may transmit a control signal for controlling a locking state of a door, starting a vehicle, operating an air-conditioning and heating system, opening and shutting a sun roof, and/or opening and shutting a window to the external device through the first antenna radiator 120 and/or the second antenna radiator 130. The electronic device 100 is illustrated in FIGS. 2A, 2B, and 2C as including one control button 140. However, the present disclosure is not be limited thereto. For example, the electronic device 100 may include two or more control buttons 140. In addition, the electronic device 100 is illustrated in FIGS. 2A, 2B, and 2C as including the control button 140 implemented as a physical button. However, the present disclosure is not be limited thereto. For example, the electronic device 100 may include a control button implemented as a touch button or a soft key.

Figure 3:
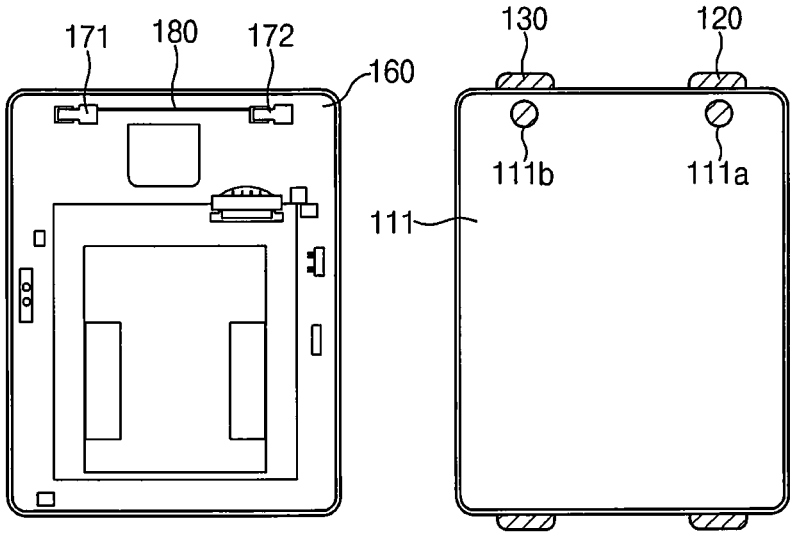
FIG. 3 illustrates an internal structure of an electronic device, according to an embodiment of the present disclosure.

FIG. 3 illustrates an internal structure of an electronic device, according to an embodiment of the present disclosure.

Referring to FIG. 3, the electronic device 100 may include a board 160 and a front housing 111. The electronic device 100 may be a vehicle key for controlling a vehicle wirelessly.

The front housing 111 may cover the board 160. A portion of the first antenna radiator 120 and a portion of the second antenna radiator 130 may be disposed on an outer surface of the front housing 111. One or more openings may be formed in the front housing 111. For example, a first opening 111*a* and a second opening 111*b* may be formed in the front housing 111. The first antenna radiator 120 may be exposed through the first opening 111*a*, and the second antenna radiator 130 may be exposed through the second opening 111*b*. The first opening 111*a* and the second opening 111*b* may be respectively formed at locations corresponding to a first connection member 171 and a second connection member 172 described below.

The board 160 may be disposed in the interior of a housing. For example, the board 160 may be a printed circuit board. Various elements of an electronic device such as a processor, a memory, and/or a communication circuit may be disposed on the board 160. According to an embodiment of the present disclosure, the board 160 may include a conductive line 180, the first connection member 171, and the second connection member 172.

The conductive line 180 may be disposed in the interior of the housing 111. For example, the conductive line 180 may be disposed on the board 160. The conductive line 180 may electrically connect the first antenna radiator 120 and the second antenna radiator 130. For example, the conductive line 180 may electrically connect the first connection member 171 and the second connection member 172 that are electrically connected to the first antenna radiator 120 and the second antenna radiator 130, respectively.

The first connection member 171 and the second connection member 172 may be disposed on the board 160. The first connection member 171 may electrically connect one end of the conductive line 180 and the first antenna radiator 120. The first connection member 171 may electrically make contact with the first antenna radiator 120 through the first opening 111*a*. The second connection member 172 may electrically connect an opposite end of the conductive line 180 and the second antenna radiator 130. The second connection member 172 may electrically make contact with the second antenna radiator 130 through the second opening 111*b*. For example, each of the first connection member 171 and the second connection member 172 may be a C-clip.

Figure 4:
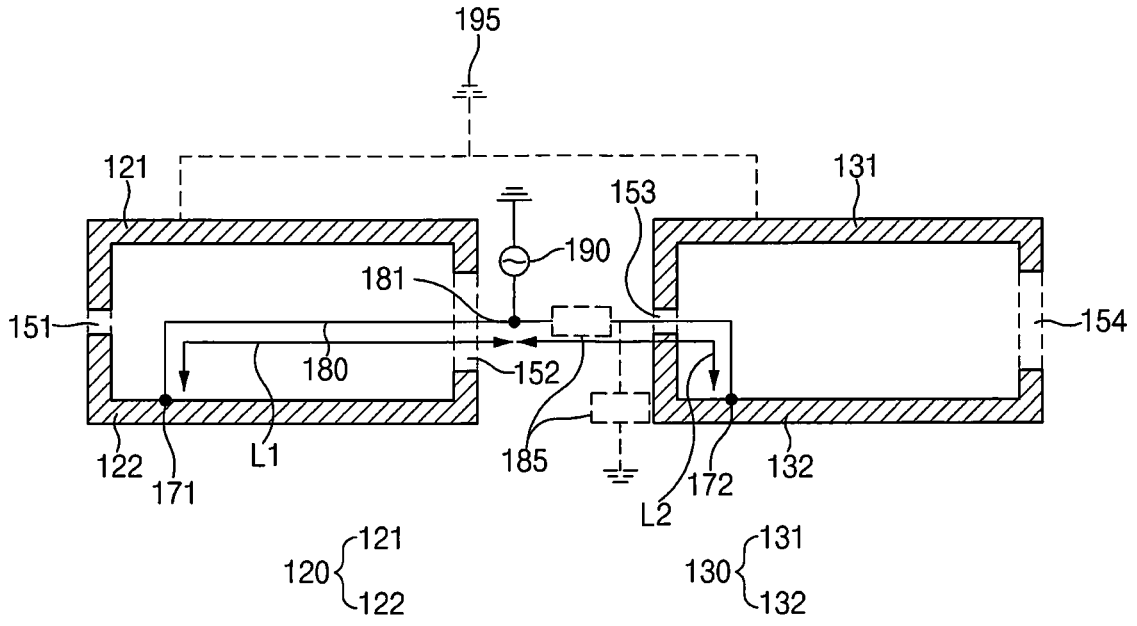
FIG. 4 illustrates an antenna included in an electronic device, according to an embodiment of the present disclosure.

FIG. 4 illustrates an antenna included in an electronic device, according to an embodiment of the present disclosure.

Referring to FIG. 4, an electronic device may include the first antenna radiator 120, the second antenna radiator 130, a length adjustment element 185, a feeding part 190, and a ground part 195.

The first antenna radiator 120 may include the first conductive member 121 and the second conductive member 122. One end of the first conductive member 121 may be spaced apart from one end of the second conductive member 122. In addition, an opposite end of the first conductive member 121 may be spaced apart from an opposite end of the second conductive member 122. For example, a distance between one end of the first conductive member 121 and one end of the second conductive member 122 may be shorter than a distance between the opposite end of the first conductive member 121 and the opposite end of the second conductive member 122. The first conductive member 121 and the second conductive member 122 may be electrically coupled to each other. If the first conductive member 121 and the second conductive member 122 are electrically coupled to each other, the first conductive member 121 and the second conductive member 122 may operate as the first antenna radiator 120. The first antenna radiator 120 is illustrated in FIG. 4 as including the first conductive member 121 and the second conductive member 122. However, the present disclosure is not be limited thereto. For example, the first antenna radiator 120 may be implemented with one conductive member. For example, the first antenna radiator 120 may be formed in a C-shape in which the first area 151 is filled, a C-shape in which the second area 152 is filled, or a loop-shape in which the first area 151 and the second area 152 are all filled. In addition, the first conductive member 121 and the second conductive member 122 may be electrically connected to each other through another conductive member.

The second antenna radiator 130 may include the third conductive member 131 and the fourth conductive member 132. The third conductive member 131 and the fourth conductive member 132 may be formed in the same shape as the first conductive member 121 and the second conductive member 122, respectively. In addition, the third conductive member 131 and the fourth conductive member 132 may be disposed to be symmetrical to the first conductive member 121 and the second conductive member 122, respectively. The third conductive member 131 and the fourth conductive member 132 may be electrically connected to each other. If the third conductive member 131 and the fourth conductive member 132 are electrically coupled to each other, the third conductive member 131 and the fourth conductive member 132 may operate as one antenna radiator. The second antenna radiator 130 is illustrated in FIG. 4 as including the third conductive member 131 and the fourth conductive member 132. However, the present disclosure is not be limited thereto. For example, the second antenna radiator 130 may be implemented with one conductive member. For example, the second antenna radiator 130 may be formed in a C-shape in which the third area 153 is filled, a C-shape in which the fourth area 154 is filled, or a loop-shape in which the third area 153 and the fourth area 154 are each filled. In addition, the third conductive member 131 and the fourth conductive member 132 may be electrically connected to each other through another conductive member.

The conductive line 180 may electrically connect the first antenna radiator 120 and the second antenna radiator 130. One end of the conductive line 180 may be connected to one point of the first antenna radiator 120 through the first connection member 171. An opposite end of the conductive line 180 may be connected to one point of the second antenna radiator 130, which corresponds to a point of the first antenna radiator 120, through the second connection member 172. For example, the conductive line 180 may be connected to the second conductive member 122 of the first antenna radiator 120 and the fourth conductive member 132 of the second antenna radiator 130.

The feeding part 190 may be electrically connected with one point (a feeding point 181) of the conductive line 180. The feeding part 190 may supply power to the feeding point 181 of the conductive line 180. The feeding part 190 may be electrically connected with the feeding point 181 through a connection member that is similar to the first connection member 171 or the second connection member 172. An electrical signal supplied by the feeding part 190 may be transferred to the first antenna radiator 120 and the second antenna radiator 130. An electrical signal supplied by the feeding part 190 may be transmitted to an external device through the first antenna radiator 120 and/or the second antenna radiator 130.

According to an embodiment of the present disclosure, the length adjustment element 185 may be interposed between the feeding point 181 of the conductive line 180 and the second antenna radiator 130. The length adjustment element 185 may be configured to adjust an electrical length L2 between the feeding point 181 of the conductive line 180 and the second antenna radiator 130. For example, the length adjustment element 185 may include an inductive element and/or a capacitive element. For example, the length adjustment element 185 may be implemented with a transmission line. As illustrated in FIG. 4, the length adjustment element 185 may be connected in series or in parallel with the conductive line 180. The length adjustment element 185 may be a selective element, and the electronic device 100 may omit the length adjustment element 185.

The feeding part 190, the feeding point 181 of the conductive line 180, and the first antenna radiator 120 may form a first electrical path. A resonant frequency of the first antenna radiator 120 may be adjusted according to a length (a first electrical length L1) of the first electrical path. The feeding part 190, the feeding point 181 of the conductive line 180, and the second antenna radiator 130 may form a second electrical path. A resonant frequency of the second antenna radiator 130 may be adjusted according to a length (a second electrical length L2) of the second electrical path.

The first electrical length L1 may be designed such that the resonant frequency of the first antenna radiator 120 coincides with a target frequency. For example, the first electrical length L1 may be designed such that the resonant frequency of the first antenna radiator 120 is about 300 MHz to about 450 MHz (e.g., about 315 MHz or about 433 MHz). For example, the first electrical length L1 may be about 18 cm to about 25 cm. For example, the first electrical length L1 and the second electrical length L2 may be different from each other. For example, the second electrical length L2 may be less than the first electrical length L1. In this case, a resonant frequency of the second antenna radiator 130 may be higher than the target frequency. The second electrical length L2 may be adjusted by the length adjustment element 185.

The ground part 195 may be electrically connected with the first antenna radiator 120 and the second antenna radiator 130. For example, the ground part 195 may be connected to one point of the first antenna radiator 120. The ground part 195 may be electrically connected to one point of the second antenna radiator 130, which corresponds to the point of the first antenna radiator 120. For example, the ground part 195 may be connected to the first conductive member 121 of the first antenna radiator 120 and the third conductive member 131 of the second antenna radiator 130. The first antenna radiator 120 and the second antenna radiator 130 are illustrated in FIG. 4 as being connected to the ground part 195. However, the ground part 195 that is a selective element may omit a connection to the first antenna radiator 120 and the second antenna radiator 130.

Characteristics of the first antenna radiator 120 and the second antenna radiator 130 that are determined according to whether contact to an external object is made is described below.

According to an embodiment of the present disclosure, a first band that is a frequency band supported by the first antenna radiator 120 may include the target frequency. The first band may be a frequency band in which a reflection coefficient of the first antenna radiator 120 is lower than a certain value or a frequency band in which efficiency of the first antenna radiator 120 is greater than a certain value. In a case where the first antenna radiator 120 does not make contact with an external object, the first band may include the target frequency. An electrical signal supplied by the feeding part 190 may be transferred to the first antenna radiator 120 and the second antenna radiator 130 and may be radiated from the first antenna radiator 120 and the second antenna radiator 130. However, in a case where the first band includes the target frequency (in a case where the first antenna radiator 120 does not make contact with an external object), since the efficiency of the first antenna radiator 120 is greater than the efficiency of the second antenna radiator 130, an electrical signal supplied by the feeding part 190 may be radiated mainly through the first antenna radiator 120. In addition, an electrical signal radiated from an external device may be received through the first antenna radiator 120 and the second antenna radiator 130. However, since the efficiency of the first antenna radiator 120 is greater than the efficiency of the second antenna radiator 130, the electrical signal may be mainly received through the first antenna radiator 120. In a case where the first antenna radiator 120 makes contact with an external object or in a case where the first antenna radiator 120 and the second antenna radiator 130 make contact with the external object (e.g., in a case where an electronic device is gripped by a user's hand), the first band that is a band supported by the first antenna radiator 120 may be relatively low compared with the case where the first antenna radiator 120 does not make contact with the external object.

According to an embodiment of the present disclosure, a second band that is a frequency band supported by the second antenna radiator 130 may be higher than the first band. The second band may be a frequency band in which a reflection coefficient of the second antenna radiator 130 is less than a certain value or a frequency band in which the efficiency of the second antenna radiator 130 is greater than a certain value. In a case where the second antenna radiator 130 does not make contact with an external object, the second band may be higher than the first band. In a case where the second antenna radiator 130 makes contact with an external object or in a case where the first antenna radiator 120 and the second antenna radiator 130 make contact with the external object (e.g., in a case where an electronic device is gripped by a user's hand), the second band may include the target frequency. An electrical signal supplied by the feeding part 190 may be transferred to the first antenna radiator 120 and the second antenna radiator 130 and may be radiated from the first antenna radiator 120 and the second antenna radiator 130. However, in a case where the second band includes the target frequency (in a case where the second antenna radiator 130 makes contact with an external object), since the efficiency of the second antenna radiator 130 is greater than the efficiency of the first antenna radiator 120, an electrical signal supplied by the feeding part 190 may be radiated through the second antenna radiator 130. In addition, an electrical signal radiated from an external device may be received through the first antenna radiator 120 and the second antenna radiator 130. However, since the efficiency of the second antenna radiator 130 is greater than the efficiency of the first antenna radiator 120, the electrical signal may be mainly received through the second antenna radiator 130.

As described above, an electronic device according to an embodiment of the present disclosure may include the first antenna radiator 120 that transmits and receives a signal having the target frequency in a case where the electronic device is not gripped by a user and the second antenna radiator 130 that transmits and receives a signal having the target frequency in a case where the electronic device is gripped by the user. The electronic device may transmit and receive a signal having the target frequency regardless of whether the electronic device is gripped by the user, by using two antenna radiators of similar structures. In addition, since power is supplied in common to two antenna radiators, a signal may be efficiently transmitted and received without an additional element such as a switch.

According to various embodiments of the present disclosure, each of a first antenna including the first antenna radiator 120 and a second antenna including the second antenna radiator 130 may be implemented with a planar inverted F antenna (PIFA), a monopole antenna, or a loop antenna.

Figure 5:
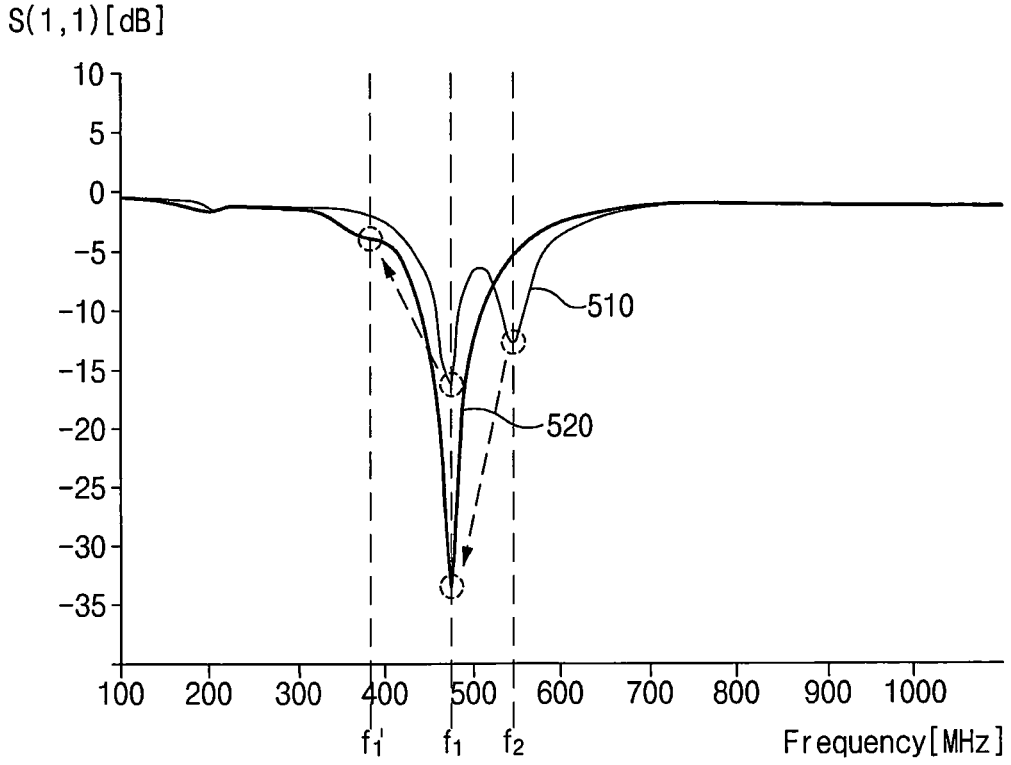
FIG. 5 is a graph illustrating an S-parameter corresponding to a frequency of an antenna included in an electronic device, according to an embodiment of the present disclosure.

FIG. 5 is a graph illustrating an S-parameter corresponding to a frequency of an antenna included in an electronic device, according to an embodiment of the present disclosure.

Referring to FIG. 5, a first curve 510 indicates a reflection coefficient of an antenna that includes a first antenna radiator (e.g., the first antenna radiator 120 of FIG. 4) and a second antenna radiator (e.g., the second antenna radiator 130 of FIG. 4) in a case where the electronic device 100 of FIGS. 1 to 4 is not gripped by a user (free state). A second curve 520 indicates a reflection coefficient of the antenna that includes the first antenna radiator and the second antenna radiator in the case where the electronic device 100 of FIGS. 1 to 4 is gripped by the user (hand-held state).

The antenna may resonate at a first frequency f1 and a second frequency f2 in the free state. The resonance at the first frequency f1 may be mainly generated by the influence of the first antenna radiator, and the resonance at the second frequency f2 may be mainly generated by influence of the second antenna radiator. The first antenna radiator may be designed to resonate at the first frequency f1 in the free state, and the second antenna radiator may be designed to resonate at the second frequency f2 in the free state. A target frequency may be the first frequency f1 or may be a frequency that is close to the first frequency f1. In the free state, the first antenna radiator may operate as a main radiator, and the second antenna radiator may operate as a sub radiator. In the free state, the antenna may transmit and receive a signal of the target frequency through the first antenna radiator.

In addition, the antenna may resonate at the second frequency f2 in the hand-held state. A resonant frequency of the antenna may be low in the hand-held state as compared to the free state. The resonance at the first frequency f1 may be mainly generated by the influence of the second antenna radiator. The first antenna radiator may be designed to resonate at a third frequency f1' in the hand-held state, and the second antenna radiator may be designed to resonate at the first frequency f1 in the hand-held state. The target frequency may be the first frequency f1 or may be a frequency that is close to the first frequency f1. In the hand-held state, the second antenna radiator may operate as a main radiator, and the first antenna radiator may operate at a sub radiator. In the hand-held state, the antenna may transmit and receive a signal of the target frequency through the second antenna radiator.

As described above, a signal of the target frequency may be mainly transmitted and received through the first antenna radiator in the free state by adjusting an electrical length between a feeding point (e.g., the feeding point 181 of FIG. 4) and the first antenna radiator such that the first antenna radiator resonates at the first frequency f1 in the free state. In addition, a signal of the target frequency may be mainly transmitted and received through the second antenna radiator in the hand-held state by adjusting an electrical length between the feeding point and the second antenna radiator such that the second antenna radiator resonates at the first frequency f1 in the hand-held state.

Figure 6:
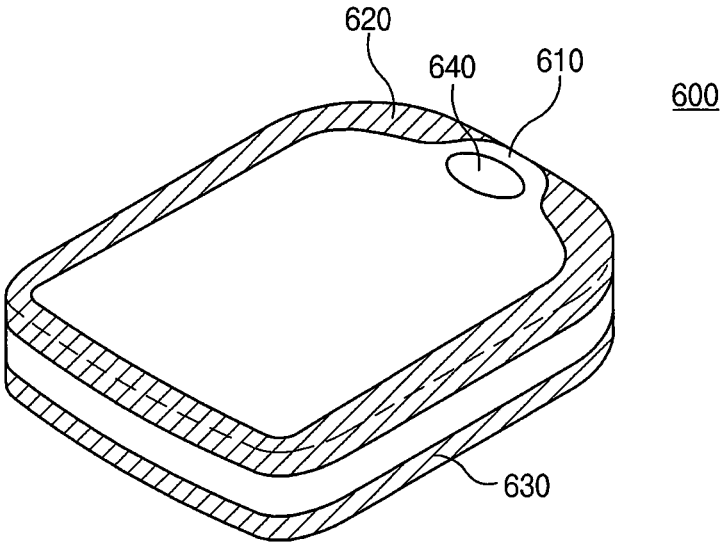
FIG. 6 illustrates an electronic device, according to an embodiment of the present disclosure.

FIG. 6 illustrates an electronic device 600, according to an embodiment of the present disclosure.

Referring to FIG. 6, the electronic device 600 may include a housing 610, a first antenna radiator 620, a second antenna radiator 630, and a control button 640. The electronic device 600 may be a vehicle key for controlling a vehicle wirelessly.

According to an embodiment of the present disclosure, the first antenna radiator 620 may extend along a periphery of a front surface of the electronic device 600. The first antenna radiator 620 may be formed to extend along an edge of the front surface of the electronic device 600. The first antenna radiator 620 may have a C-shape that surrounds the front surface of the electronic device 600. The first antenna radiator 620 may be configured to transmit a signal having a target frequency to an external device (e.g., the external device 10 of FIG. 1). In addition, the first antenna radiator 620 may be configured to receive a signal having the target frequency from the external device. The first antenna radiator 620 may be designed to transmit and receive a signal having the target frequency in the case where the first antenna radiator 620 does not make contact with an external object.

According to an embodiment of the present disclosure, the second antenna radiator 630 may extend along a periphery of a rear surface of the electronic device 600. For example, the second antenna radiator 630 may be formed to extend along an edge of the rear surface of the electronic device 600. The second antenna radiator 630 may have a C-shape that surrounds the rear surface of the electronic device 600. The second antenna radiator 630 may have the same shape as the first antenna radiator 620 and may be disposed to be symmetrical to the first antenna radiator 620. The second antenna radiator 630 may be configured to transmit a signal having the target frequency to an external device (e.g., the external device 10 of FIG. 1). In addition, the second antenna radiator 630 may be configured to receive a signal having the target frequency from the external device. The second antenna radiator 630 may be configured to transmit and receive a signal having the target frequency in the case where the second antenna radiator 630 makes contact with an external object. The electronic device 600 illustrated in FIG. 6 may operate to be similar to the electronic device 100 illustrated in FIGS. 1 to 4.

Figure 7:
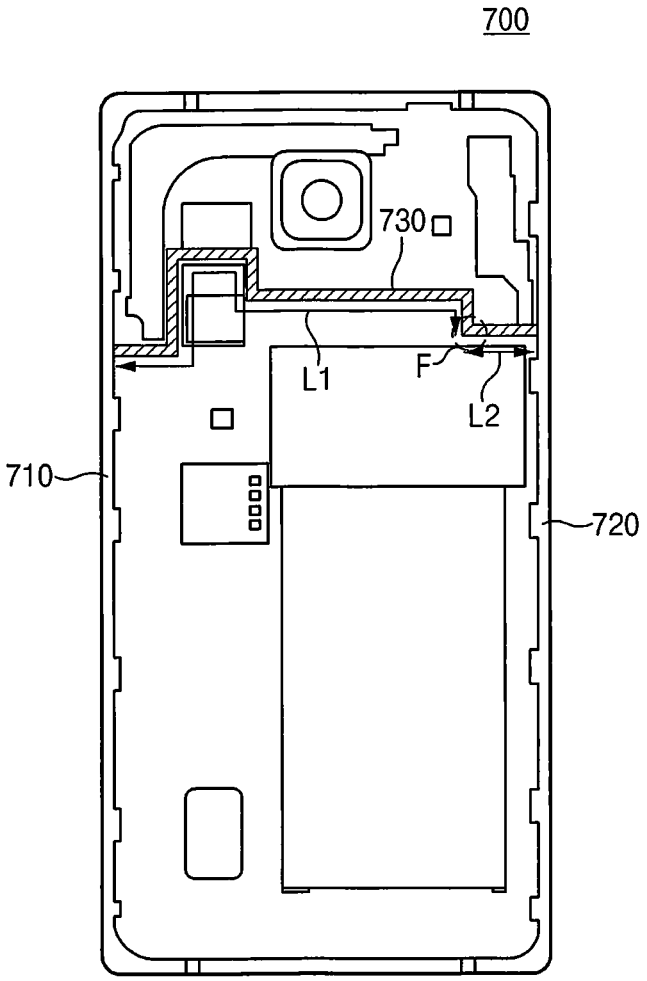
FIG. 7 illustrate an internal structure of an electronic device, according to an embodiment of the present disclosure.

FIG. 7 illustrates an internal structure of an electronic device 700, according to an embodiment of the present disclosure.

Referring to FIG. 7, the electronic device 700 may include a first antenna radiator 710, a second antenna radiator 720, and a conductive line 730. For example, the electronic device 700 may be a mobile device such as a smartphone, a tablet PC, or the like.

The first antenna radiator 710 may be a portion of a metal frame that constitutes a side surface of a housing of the electronic device 700. The metal frame may be partitioned into a plurality of metal frames. The first antenna radiator 710 may be a metal frame, which is disposed on a left side of the housing, from among the partitioned metal frames.

The second antenna radiator 720 may be a portion of the metal frame that constitutes the side surface of the housing of the electronic device 700. The second antenna radiator 720 may be a metal frame, which is disposed on a right side of the housing, from among the partitioned metal frames.

The conductive line 730 may be electrically connected to the first antenna radiator 710 and the second antenna radiator 720. The conductive line 730 may extend from one point on the first antenna radiator 710 to one point on the second antenna radiator 720. The conductive line 730 may connect the first antenna radiator 710 and the second antenna radiator 720 along a detour such that a targeted electrical length is secured.

According to an embodiment of the present disclosure, a feeding part may be electrically connected to one point (a feeding point F) on the conductive line 730. The feeding part may supply power to the feeding point "F" on the conductive line 730. A signal supplied to the feeding point "F" on the conductive line 730 may be transferred to the first antenna radiator 710 and the second antenna radiator 720 through the conductive line 730. An electrical length (a first electrical length) between the feeding point "F" of the conductive line 730 and the first antenna radiator 710 may be different from an electrical length (a second electrical length) between the feeding point "F" on the conductive line 730 and the second antenna radiator 720. Due to a difference between the first electrical length and the second electrical length, a resonant frequency of the first antenna radiator 710 may be different from a resonant frequency of the second antenna radiator 720.

Figures 8A, 8B, 8C:
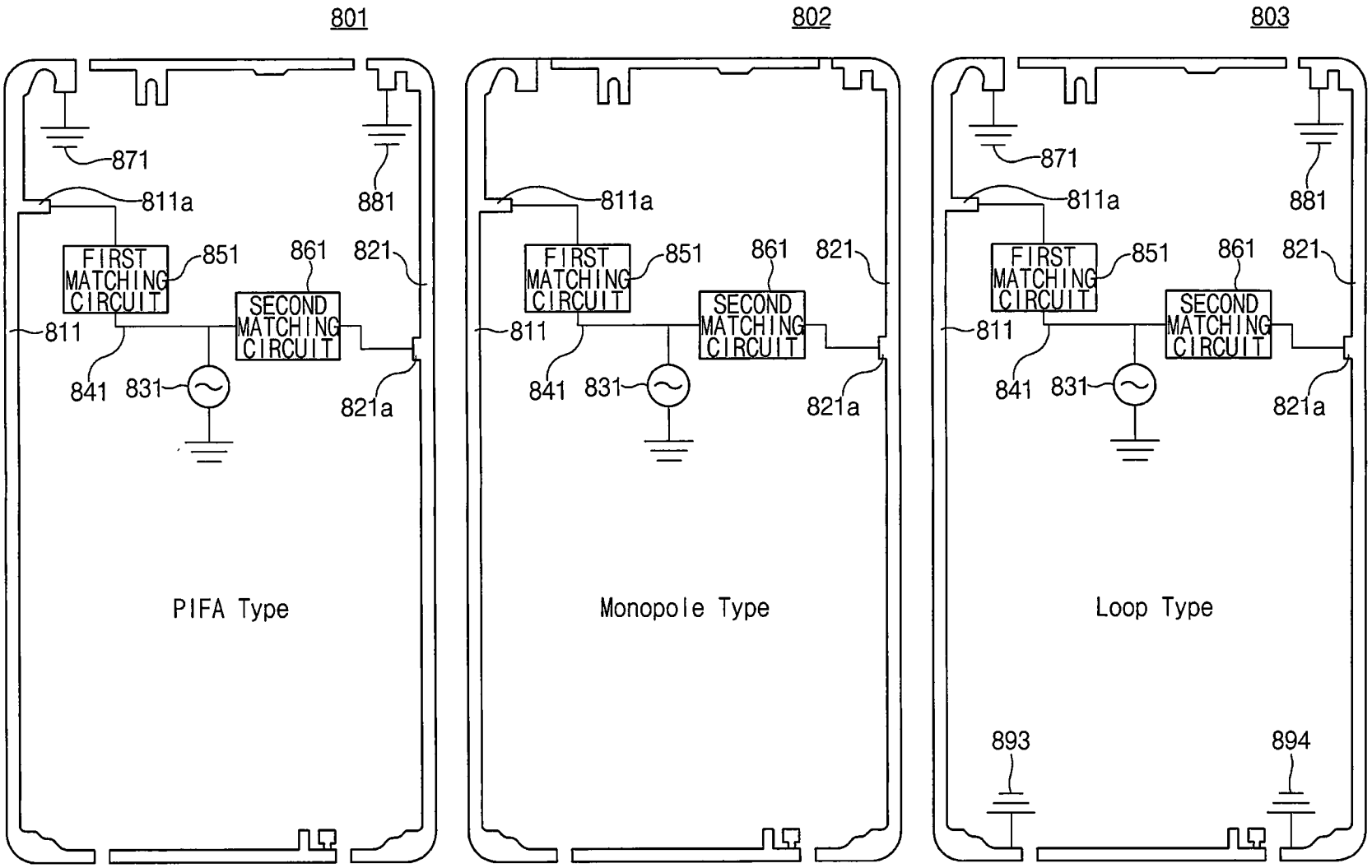
FIGS. 8A, 8B, and 8C illustrate antennas included in electronic devices, according to embodiments of the present disclosure.

FIGS. 8A, 8B, and 8C illustrate antennas included in an electronic device, according to an embodiment of the present disclosure.

Referring to FIG. 8A, an electronic device 801 may include a first antenna radiator 811, a second antenna radiator 821, a feeding part 831, a conductive line 841, a first matching circuit 851, a second matching circuit 861, a first ground part 871, and a second ground part 881. The electronic device 801 may operate as a PIFA or an inverted F antenna (IFA) including the above-described elements.

The first antenna radiator 811 may include a left-side part of a metal frame. The first antenna radiator 811 may extend in a vertical direction of the electronic device 801. The first antenna radiator 811 may include a first flange 811*a* that extends toward the interior of the electronic device 801. One end of the first antenna radiator 811 may be electrically connected to the first ground part 871.

The second antenna radiator 821 may include a right-side part of the metal frame. The second antenna radiator 821 may extend in the vertical direction of the electronic device 801. The second antenna radiator 821 may include a second flange 821*a* that extends toward the interior of the electronic device 801. A location of the first flange 811*a* may be asymmetrical to a location of the second flange 821*a*. In a case where the location of the first flange 811*a* is asymmetrical to the location of the second flange 821*a*, an electrical length of the first antenna radiator 811 may be different from an electrical length of the second antenna radiator 821. One end of the second antenna radiator 821 may be electrically connected to the second ground part 881.

The feeding part 831 may supply power to the first antenna radiator 811 and the second antenna radiator 821. The feeding part 831 may be electrically connected to one point of the conductive line 841. The feeding part 831 may supply an electrical signal to the first antenna radiator 811 and the second antenna radiator 821 through the conductive line 841. An electrical length between the feeding part 831 and the first antenna radiator 811 may be different from an electrical length between the feeding part 831 and the second antenna radiator 821.

The conductive line 841 may electrically connect the first flange 811*a* of the first antenna radiator 811 and the second flange 821*a* of the second antenna radiator 821. The conductive line 841 may transfer an electrical signal, which is supplied from the feeding part 831 connected to one point of the conductive line 841, to the first flange 811*a* and the second flange 821*a*.

The first matching circuit 851 may be disposed on an electrical path between the feeding part 831 and the first antenna radiator 811. The first matching circuit 851 may be disposed for impedance matching between the feeding part 831 and the first antenna radiator 811.

The second matching circuit 861 may be disposed on an electrical path between the feeding part 831 and the second antenna radiator 821. The second matching circuit 861 may be disposed for impedance matching between the feeding part 831 and the second antenna radiator 821.

The first matching circuit 851 and the second matching circuit 861 are illustrated in FIG. 8A as being connected in series to the conductive line 841. However, the present disclosure is not limited thereto. For example, the first matching circuit 851 and the second matching circuit 861 may be connected in parallel to the conductive line 841.

Characteristics of the first antenna radiator 811 and the second antenna radiator 821 that are determined according to whether a contact with an external object is made is described below.

According to an embodiment of the present disclosure, a first band that is a frequency band supported by the first antenna radiator 811 may include a target frequency. In a case where the first antenna radiator 811 does not make contact with an external object, the first band may include the target frequency. In a case where the first band includes the target frequency, an electrical signal having the target frequency may be transmitted and received in a frequency band (a first band) supported by the first antenna radiator 811. For example, an electrical signal having the target frequency may be transmitted and received at a resonant frequency that is determined according to an electrical length (e.g., an electrical length from a point, at which the first flange 811*a* is formed, to a lower end of the first antenna radiator 811) that is based on a point at which the first flange 811*a* is formed. In a case where the first antenna radiator 811 makes contact with an external object or in a case where the first antenna radiator 811 and the second antenna radiator 821 make contact with the external object (e.g., in a case where the electronic device 801 is gripped by a user's hand), the first band may be relatively low as compared to a case where the first antenna radiator 811 does not make contact with the external object.

According to an embodiment of the present disclosure, since an electrical length formed by the feeding part 831, the conductive line 841, and the second antenna radiator 821 is less than an electrical length formed by the feeding part 831, the conductive line 841, and the first antenna radiator 811, a second band that is a frequency band supported by the second antenna radiator 821 may be higher than the first band. In a case where the second antenna radiator 821 makes contact with an external object or in a case where the first antenna radiator 811 and the second antenna radiator 821 make contact with the external object (e.g., in a case where the electronic device 801 is gripped by a user's hand), the second band may include the target frequency. In a case where the second band includes the target frequency, an electrical signal having the target frequency may be transmitted and received in a frequency band (a second band) determined by the second antenna radiator 821. For example, an electrical signal having the target frequency may be transmitted and received at a resonant frequency that is determined according to an electrical length (e.g., an electrical length from a point, at which the second flange 821*a* is formed, to a lower end of the second antenna radiator 821) that is based on a point at which the second flange 821*a* is formed.

As described above, the electronic device 801 according to an embodiment of the present disclosure may include the first antenna radiator 811 that transmits and receives a signal having the target frequency in a case where the electronic device 801 is not gripped by a user and the second antenna radiator 821 that transmits and receives a signal having the target frequency in a case where the electronic device 801 is gripped by the user. The electronic device 801 may transmit and receive a signal having the target frequency regardless of whether the electronic device 801 is gripped by the user, by using two antenna radiators of similar structures. In addition, since power is supplied in common to two antenna radiators, the electronic device 801 may efficiently transmit and receive a signal without an additional element such as a switch.

An antenna including the first antenna radiator 811 and the second antenna radiator 821 of the electronic device 801 may be a PIFA.

Referring to FIG. 8B, the first antenna radiator 811 and the second antenna radiator 821 of an electronic device 802 may not be connected to a ground part. In this case, an antenna including the first antenna radiator 811 and the second antenna radiator 821 of the electronic device 802 may be a monopole antenna.

Referring to FIG. 8C, one end of the first antenna radiator 811 of an electronic device 803 may be connected to the first ground part 871, and an opposite end of the first antenna radiator 811 may be electrically connected to a third ground part 893. One end of the second antenna radiator 821 of the electronic device 803 may be connected to the second ground part 881, and an opposite end of the second antenna radiator 821 may be electrically connected to a fourth ground part 894. In this case, an antenna including the first antenna radiator 811 and the second antenna radiator 821 may be a loop antenna.

Figure 9:
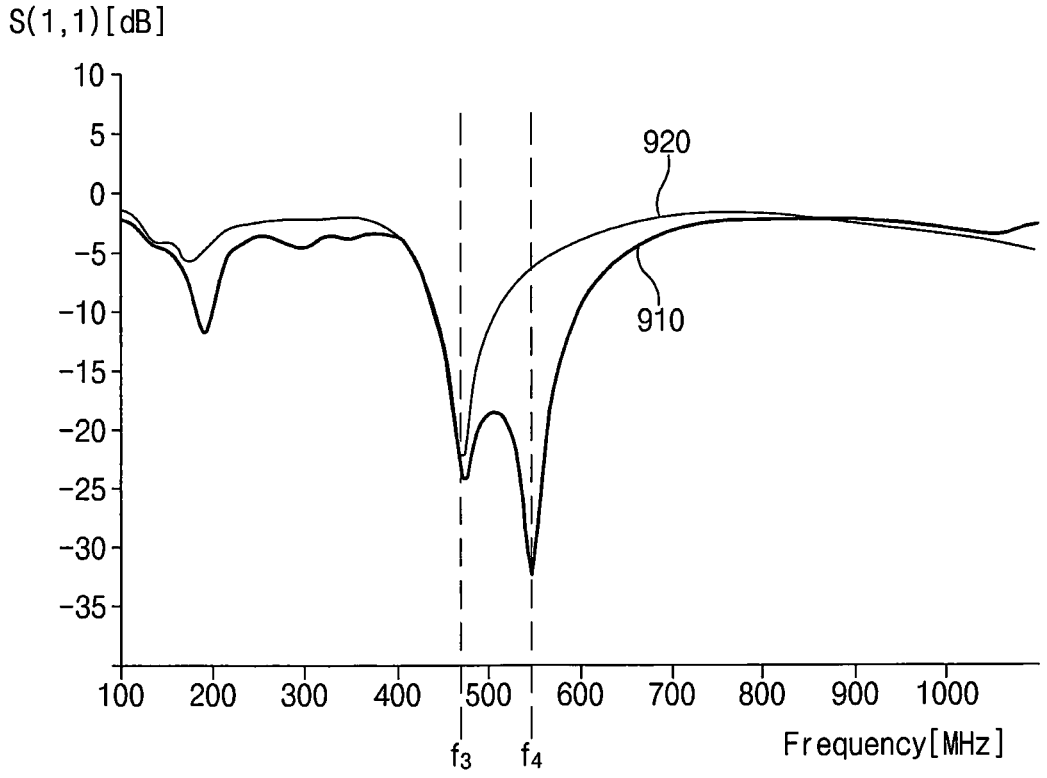
FIG. 9 is a graph illustrating an S-parameter corresponding to a frequency of an antenna included in an electronic device, according to an embodiment of the present disclosure.

FIG. 9 is a graph illustrating an S-parameter corresponding to a frequency of an antenna included in an electronic device, according to an embodiment of the present disclosure.

Referring to FIG. 9, a first curve 910 indicates a reflection coefficient of an antenna that includes a first antenna radiator (e.g., the first antenna radiator 811 of FIG. 8) and a second antenna radiator (e.g., the second antenna radiator 821 of FIG. 8) in the case where the electronic device 801 of FIG. 8 is not gripped by a user (a free state). A second curve 920 indicates a reflection coefficient of the antenna that includes the first antenna radiator and the second antenna radiator in a case where the electronic device 801 of FIG. 8 is gripped by the user (a hand-held state).

The antenna may resonate at a first frequency f3 and a second frequency f4 in the free state. The resonance at the first frequency f3 may be mainly generated by the influence of the first antenna radiator, and the resonance at the second frequency f4 may be mainly generated by the influence of the second antenna radiator. The first antenna radiator may be designed to resonate at the first frequency f3 in the free state, and the second antenna radiator may be designed to resonate at the second frequency f4 in the free state. The target frequency may be the first frequency f3 or may be a frequency that is close to the first frequency f3. In the free state, the first antenna radiator may operate as a main radiator, and the second antenna radiator may operate as a sub radiator. In the free state, the antenna may transmit and receive a signal of the target frequency mainly through the first antenna radiator.

In addition, the antenna may resonate at the first frequency f3 in the hand-held state. A resonant frequency of the antenna may be low in the hand-held state as compared to the free state. The resonance at the first frequency f3 may be mainly generated by the influence of the second antenna radiator. The target frequency may be the first frequency f3 or may be a frequency that is close to the first frequency B. In the hand-held state, the second antenna radiator may operate as a main radiator, and the first antenna radiator may operate as a sub radiator. In the hand-held state, the antenna may transmit and receive a signal of the target frequency through the second antenna radiator.

Figure 10:
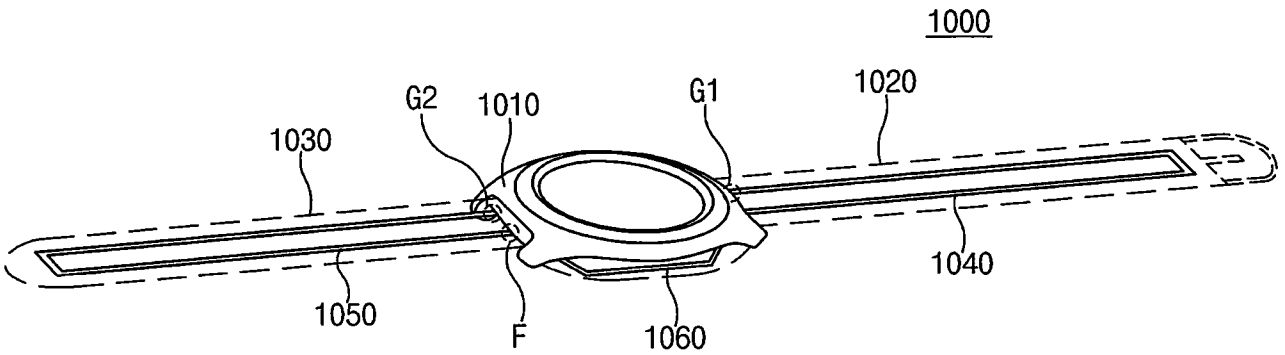
FIG. 10 illustrates an internal structure of an electronic device, according to an embodiment of the present disclosure.

FIG. 10 illustrates an internal structure of an electronic device 1000, according to an embodiment of the present disclosure.

Referring to FIG. 10, the electronic device 1000 may include a housing 1010, a first strap 1020, a second strap 1030, a first antenna radiator 1040, a second antenna radiator 1050, and a conductive line 1060. For example, the electronic device 1000 may be a wearable electronic device (e.g., a smart watch) that is capable of controlling a vehicle.

The housing 1010 may surround elements (e.g., a processor, a memory, and/or a communication circuit) of the electronic device 1000. The housing is illustrated in FIG. 10 as having a circular shape. However, the present disclosure is not limited thereto. For example, the housing 1010 may have various shapes.

The first strap 1020 may be connected to the housing 1010. The first strap 1020 may extend in a direction that is opposite to the housing 1010. For example, the first strap 1020 may be formed of a material such as leather, rubber, or the like.

The second strap 1030 may be connected to the housing 1010. The second strap 1030 may be connected to the housing 1010 in a direction that is opposite to the first strap 1020. The second strap 1030 may extend in a direction that is opposite to the first strap 1020. For example, the second strap 1030 may be formed of a material such as leather, rubber, or the like.

The first antenna radiator 1040 may be disposed on the outside of the housing 1010. According to an embodiment of the present disclosure, the first antenna radiator 1040 may be embedded in the first strap 1020. For example, the first antenna radiator 1040 may have a U-shape in which a start point and an end point thereof are electrically connected to the interior of the housing 1010. The first antenna radiator 1040 may be configured to transmit a signal having a target frequency to an external device (e.g., the external device 10 of FIG. 1). The first antenna radiator 1040 may be configured to receive a signal having the target frequency from the external device. The first antenna radiator 1040 may have an electrical length corresponding to the target frequency.

The second antenna radiator 1050 may be disposed on the outside of the housing 1010. According to an embodiment of the present disclosure, the second antenna radiator 1050 may be embedded in the second strap 1030. For example, the second antenna radiator 1050 may have a U-shape in which a start point and an end point thereof are electrically connected to the interior of the housing 1010. For example, the second antenna radiator 1050 may be formed to be symmetrical to the first antenna radiator 1040 and may have the same shape as the first antenna radiator 1040. The second antenna radiator 1050 may be configured to transmit and receive a signal having the target frequency. The second antenna radiator 1050 may have an electrical length corresponding to the target frequency.

The conductive line 1060 may electrically connect the first antenna radiator 1040 and the second antenna radiator 1050. The conductive line 1060 may be disposed in the interior of the housing 1010. One end of the conductive line 1060 may be electrically connected to the first antenna radiator 1040, and an opposite end thereof may be electrically connected to the second antenna radiator 1050. A feeding part may be electrically connected with one point "F" of the conductive line 1060.

The feeding part may supply power to the point "F" of the conductive line 1060. An electrical signal supplied by the feeding part may be transferred to the first antenna radiator 1040 and the second antenna radiator 1050 through the conductive line 1060. An electrical signal supplied by the feeding part may be transmitted to the external device through the first antenna radiator 1040 and/or the second antenna radiator 1050.

The feeding part, the point "F" of the conductive line 1060, and the first antenna radiator 1040 may form a first electrical path. A resonant frequency of the first antenna radiator 1040 may be adjusted according to a length of the first electrical path. The feeding part, the point "F" of the conductive line 1060, and the second antenna radiator 1050 may form a second electrical path. A resonant frequency of the second antenna radiator 1050 may be adjusted according to a length of the second electrical path. As illustrated in FIG. 10, a length of the first electrical path may be greater than a length of the second electrical path.

A first ground part may be electrically connected to one point G1 of the first antenna radiator 1040. A second ground part may be electrically connected with one point G2 of the second antenna radiator 1050. The first ground part and the second ground part may be implemented with one component or may be implemented with separate components.

The electronic device 1000 illustrated in FIG. 10 may operate to be similar to the electronic device 100 illustrated in FIGS. 1 to 4 or the electronic devices 801, 802, or 803 illustrated in FIG. 8.

Figure 11:
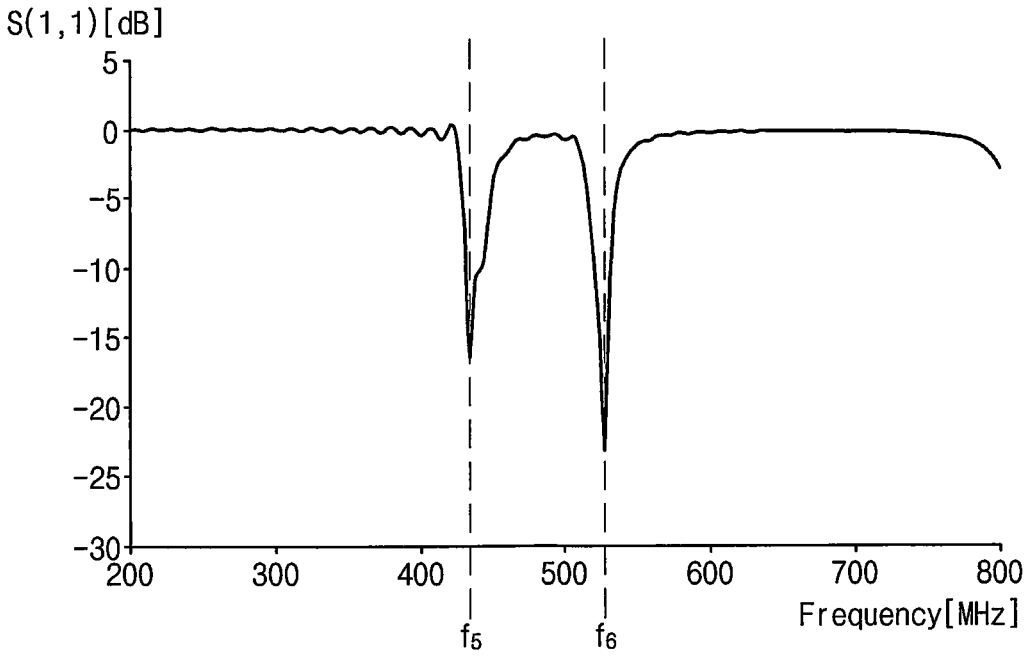
FIG. 11 is a graph illustrating an S-parameter corresponding to a frequency of an antenna included in an electronic device, according to an embodiment of the present disclosure.

FIG. 11 is a graph illustrating an S-parameter corresponding to a frequency of an antenna included in an electronic device, according to an embodiment of the present disclosure. A curve illustrated in FIG. 11 indicates a reflection coefficient of an antenna including the first antenna radiator 1040 and the second antenna radiator 1050 included in the electronic device 1000 of FIG. 10.

Referring to FIG. 11, the antenna may resonate at a first frequency f5 and a second frequency f6. The resonance at the first frequency f5 may be mainly generated by the influence of the first antenna radiator 1040, and the resonance at the second frequency f6 may be mainly generated by the influence of the second antenna radiator 1050. The target frequency may be the first frequency f5 and may be a frequency that is close to the first frequency f5. A signal of the target frequency may be mainly transmitted and received through the first antenna radiator 1040. In a case where a resonant frequency of the second antenna radiator 1050 decreases according to a state of an electronic device, a signal having the target frequency may be mainly transmitted and received through the second antenna radiator 1050.

Figure 12:
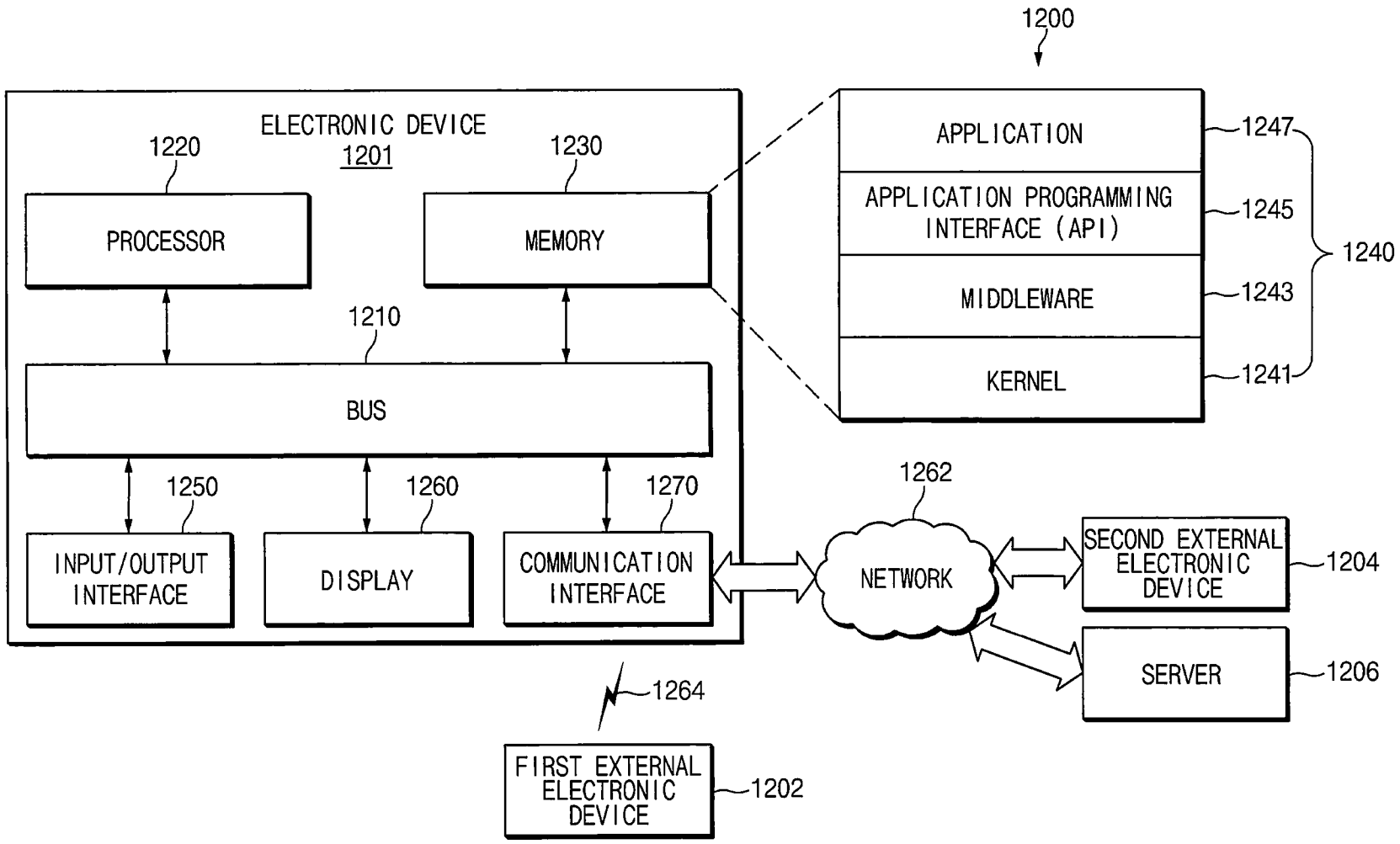
FIG. 12 illustrates an electronic device in a network environment, according to an embodiment of the present disclosure.

FIG. 12 illustrates an electronic device 1201 in a network environment system 1200, according to an embodiment of the present disclosure.

Referring to FIG. 12, electronic devices 1201, 1202, and 1204, and a server 1206 may be connected to each other over a network 1262 or a short range communication 1264. The electronic device 1201 may include a bus 1210, a processor 1220, a memory 1230, an input/output interface 1250, a display 1260, and a communication interface 1270. The electronic device 1201 may omit at least one of the above-described elements or may further include other element(s).

For example, the bus 1210 may interconnect the above-described elements 1210 to 1270 and may include a circuit for conveying communications (e.g., a control message and/or data) among the above-described elements 1210 to 1270.

The processor 1220 may include one or more of a CPU, an AP, or a communication processor (CP). For example, the processor 1220 may perform an arithmetic operation or data processing associated with control and/or communication of at least one other element of the electronic device 1201.

The memory 1230 may include a volatile and/or nonvolatile memory. For example, the memory 1230 may store instructions or data associated with at least one other element of the electronic device 1201. The memory 1230 may store software and/or a program 1240. The program 1240 may include, for example, a kernel 1241, middleware 1243, an application programming interface (API) 1245, and/or an application program (or an application) 1247. At least a part of the kernel 1241, the middleware 1243, or the API 1245 may be referred to as an operating system (OS).

For example, the kernel 1241 may control or manage system resources (e.g., the bus 1210, the processor 1220, the memory 1230, and the like) that are used to execute operations or functions of other programs (e.g., the middleware 1243, the API 1245, and the application 1247). Furthermore, the kernel 1241 may provide an interface that allows the middleware 1243, the API 1245, or the application 1247 to access discrete elements of the electronic device 1201 so as to control or manage system resources.

The middleware 1243 may perform, for example, a mediation role such that the API 1245 or the application 1247 communicates with the kernel 1241 to exchange data.

Furthermore, the middleware 1243 may process task requests received from the application 1247 according to a priority. For example, the middleware 1243 may assign the priority, which makes it possible to use a system resource (e.g., the bus 1210, the processor 1220, the memory 1230, or the like) of the electronic device 1201, to at least one of the application 1247. For example, the middleware 1243 may process the one or more task requests according to the priority assigned to the at least one of the application 1247, which makes it possible to perform scheduling or load balancing on the one or more task requests.

The API 1245 may be, for example, an interface through which the application 1247 controls a function provided by the kernel 1241 or the middleware 1243, and may include, for example, at least one interface or function (e.g., an instruction) for a file control, a window control, image processing, a character control, or the like.

The input/output interface 1250 may play a role, for example, as an interface which transmits an instruction or data input from a user or another external device, to other element(s) of the electronic device 1201. Furthermore, the input/output interface 1250 may output an instruction or data, received from other element(s) of the electronic device 1201, to a user or another external device.

The display 1260 may include, for example, a liquid crystal display (LCD), an LED display, an organic LED (OLED) display, a microelectromechanical systems (MEMS) display, or an electronic paper display. The display 1260 may display, for example, various contents (e.g., a text, an image, a video, an icon, a symbol, and the like) to a user. The display 1260 may include a touch screen and may receive, for example, a touch, a gesture, a proximity input, or a hovering input using an electronic pen or a part of a user's body.

For example, the communication interface 1270 may establish communication between the electronic device 1201 and the first external electronic device 1202, the second external electronic device 1204, or the server 1206. For example, the communication interface 1270 may be connected to the network 1262 over wireless communication or wired communication to communicate with the second external electronic device 1204 or the server 1206.

The wireless communication may use at least one of, for example, long-term evolution (LTE), LTE advanced (LTE-A), code division multiple access (CDMA), wideband CDMA (WCDMA), universal mobile telecommunications system (UMTS), wireless broadband (WiBro), global system for mobile communications (GSM), or the like, as cellular communication protocol. Furthermore, the wireless communication may include, for example, the short range communication 1264. The short range communication 1264 may include at least one of wireless fidelity (Wi-Fi), Bluetooth, near field communication (NFC), magnetic stripe transmission (MST), a global navigation satellite system (GNSS), or the like.

MST may generate a pulse in response to transmission data using an electromagnetic signal, where the pulse may generate a magnetic field signal. The electronic device 1201 may transfer the magnetic field signal to a POS device, and the POS device may detect the magnetic field signal using an MST reader. The POS device may recover data by converting the detected magnetic field signal to an electrical signal.

GNSS may include at least one of, for example, a global positioning system (GPS), a global navigation satellite system (GLONASS), a Beidou navigation satellite system (Beidou), or a European global satellite-based navigation system (Galileo) based on an available region, a bandwidth, or the like. Hereinafter, "GPS" and "GNSS" may be interchangeably used. The wired communication may include at least one of, for example, a universal serial bus (USB), a high definition multimedia interface (HDMI), a recommended standard-232 (RS-232), a plain old telephone service (POTS), or the like. The network 1262 may include at least one of telecommunications networks, for example, a computer network (e.g., a local area network (LAN) or a wide area network (WAN)), an Internet, or a telephone network.

Each of the first and second electronic devices 1202 and 1204 may be a device of which the type is different from or the same as that of the electronic device 1201. The server 1206 may include a group of one or more servers. All or a portion of the operations that the electronic device 1201 will perform may be executed by another or plural electronic devices (e.g., the electronic device 1202, the electronic device 1204 or the server 1206). In a case where the electronic device 1201 executes any function or service automatically or in response to a request, the electronic device 1201 may omit performing the function or the service internally, but, alternatively or additionally, may request that at least a portion of a function associated with the electronic device 1201 be performed by the electronic device 1202 or 1204 or the server 1206. The electronic device 1202 or 1204 or the server 1206 may execute the requested function or additional function and may transmit the execution result to the electronic device 1201. The electronic device 1201 may provide the requested function or service using the received result or may additionally process the received result to provide the requested function or service. To this end, for example, cloud computing, distributed computing, or client-server computing may be used.

Figure 13:
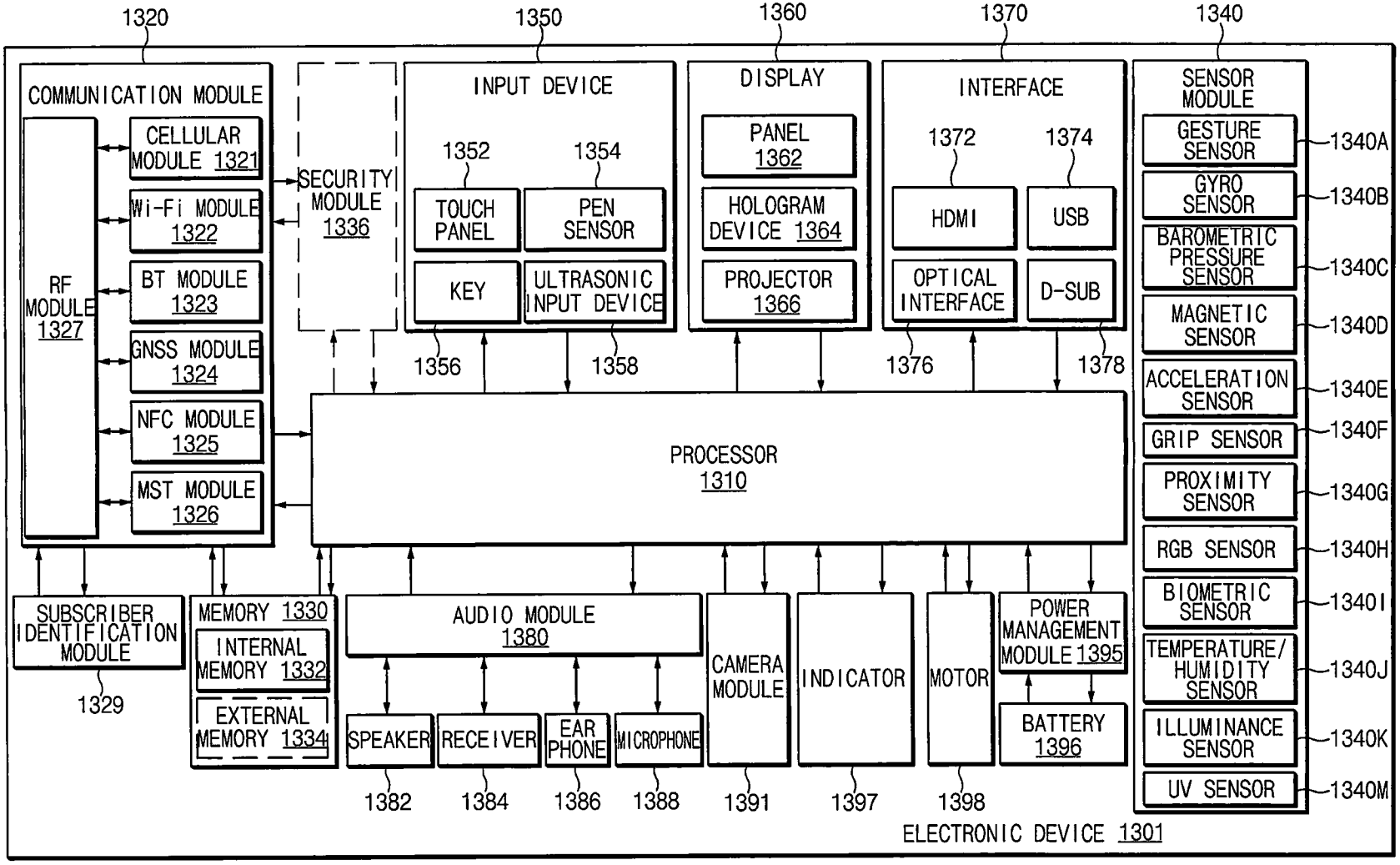
FIG. 13 illustrates a block diagram of an electronic device, according to an embodiment of the present disclosure.

FIG. 13 illustrates a block diagram of an electronic device, 1301 according to an embodiment of the present disclosure.

Referring to FIG. 13, the electronic device 1301 may include, for example, all or a part of the electronic device 1201 illustrated in FIG. 12. The electronic device 1301 may include one or more processors (e.g., an AP) 1310, a communication module 1320, a subscriber identification module 1329, a memory 1330, a sensor module 1340, an input device 1350, a display 1360, an interface 1370, an audio module 1380, a camera module 1391, a power management module 1395, a battery 1396, an indicator 1397, and a motor 1398.

The processor 1310 may drive, for example, an OS or an application to control a plurality of hardware or software elements connected to the processor 1310 and may process and compute a variety of data. For example, the processor 1310 may be implemented with a system on chip (SoC). The processor 1310 may further include a graphics processing unit (GPU) and/or an image signal processor. The processor 1310 may include at least a part (e.g., a cellular module 1321) of elements illustrated in FIG. 13. The processor 1310 may load an instruction or data, which is received from at least one other element (e.g., a nonvolatile memory), into a volatile memory and process the loaded instruction or data. The processor 1310 may store a variety of data in the nonvolatile memory.

The communication module 1320 may be configured the same as or similar to the communication interface 1270 of FIG. 12. The communication module 1320 may include the cellular module 1321, a Wi-Fi module 1322, a Bluetooth (BT) module 1323, a GNSS module 1324 (e.g., a GPS module, a GLONASS module, a Beidou module, or a Galileo module), an NFC module 1325, an MST module 1326 and a radio frequency (RF) module 1327.

The cellular module 1321 may provide, for example, voice communication, video communication, a character service, an Internet service, or the like over a communication network. The cellular module 1321 may perform discrimination and authentication of the electronic device 1301 within a communication network by using the subscriber identification module (e.g., a subscriber identification module (SIM) card) 1329. The cellular module 1321 may perform at least a portion of the functions that the processor 1310 provides. The cellular module 1321 may include a communication processor (CP).

Each of the Wi-Fi module 1322, the BT module 1323, the GNSS module 1324, the NFC module 1325, and the MST module 1326 may include a processor for processing data exchanged through a corresponding module, for example. At least a part (e.g., two or more) of the cellular module 1321, the Wi-Fi module 1322, the BT module 1323, the GNSS module 1324, the NFC module 1325, or the MST module 1326 may be included within one integrated circuit (IC) or an IC package.

For example, the RF module 1327 may transmit and receive a communication signal (e.g., an RF signal). For example, the RF module 1327 may include a transceiver, a power amplifier module (PAM), a frequency filter, a low noise amplifier (LNA), an antenna, or the like. At least one of the cellular module 1321, the Wi-Fi module 1322, the BT module 1323, the GNSS module 1324, the NFC module 1325, and the MST module 1326 may transmit and receive an RF signal through a separate RF module.

The SIM 1329 may include, for example, a card and/or an embedded SIM and may include unique identification information (e.g., an integrated circuit card identifier (ICCID)) or subscriber information (e.g., an integrated mobile subscriber identity (IMSI)).

The memory 1330 (e.g., the memory 1230) may include an internal memory 1332 or an external memory 1334. For example, the internal memory 1332 may include at least one of a volatile memory (e.g., a dynamic random access memory (DRAM), a static RAM (SRAM), a synchronous DRAM (SDRAM), or the like), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory), or the like), a hard drive, or a solid state drive (SSD).

The external memory 1334 may further include a flash drive such as a compact flash (CF) drive, a secure digital (SD) card, a micro secure digital (Micro-SD) card, a mini secure digital (Mini-SD) card, an extreme digital (xD) card, a multimedia card (MMC), a memory stick, or the like. The external memory 1334 may be operatively and/or physically connected to the electronic device 1301 through various interfaces.

A security module 1336 may be a module that includes a storage space of which a security level is higher than that of the memory 1330 and may be a circuit that guarantees safe data storage and a protected execution environment. The security module 1336 may be implemented with a separate circuit and may include a separate processor. For example, the security module 1336 may be in a smart IC or chip or an SD card, which is removable, or may include an embedded secure element (eSE) embedded in a fixed chip of the electronic device 1301. Furthermore, the security module 1336 may operate based on an OS that is different from the OS of the electronic device 1301. For example, the security module 1336 may operate based on a Java card open platform (JCOP) OS.

The sensor module 1340 may measure, for example, a physical quantity or may detect an operation state of the electronic device 1301. The sensor module 1340 may convert the measured or detected information to an electrical signal. For example, the sensor module 1340 may include at least one of a gesture sensor 1340A, a gyro sensor 1340B, a barometric pressure sensor 1340C, a magnetic sensor 1340D, an acceleration sensor 1340E, a grip sensor 1340F, a proximity sensor 1340G, a color sensor 1340H (e.g., a red, green, blue (RGB) sensor), a biometric sensor 1340I, a temperature/humidity sensor 1340J, an illuminance sensor 1340K, or an ultra violet (UV) light sensor 1340M. Additionally or generally, the sensor module 1340 may further include, for example, an electronic nose (E-nose) sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 1340 may further include a control circuit for controlling at least one or more sensors included therein. The electronic device 1301 may further include a processor that is a part of the processor 1310 or independent of the processor 1310 and is configured to control the sensor module 1340. The processor 1310 may control the sensor module 1340 while the processor 1310 remains a reduced power or sleep state.

The input device 1350 may include, for example, a touch panel 1352, a (digital) pen sensor 1354, a key 1356, or an ultrasonic input device 1358. For example, the touch panel 1352 may use at least one of capacitive, resistive, infrared and ultrasonic detecting methods. In addition, the touch panel 1352 may further include a control circuit. The touch panel 1352 may further include a tactile layer to provide a tactile reaction to a user.

The (digital) pen sensor 1354 may be, for example, a part of a touch panel or may include an additional sheet for recognition. The key 1356 may include, for example, a physical button, an optical key, a keypad, or the like. The ultrasonic input device 1358 may detect (or sense) an ultrasonic signal, which is generated from an input device, through a microphone 1388 and may check data corresponding to the detected ultrasonic signal.

The display 1360 (e.g., the display 1260) may include a panel 1362, a hologram device 1364, or a projector 1366. The panel 1362 may be the same as or similar to the display 1260 illustrated in FIG. 12. The panel 1362 may be implemented, for example, to be flexible, transparent or wearable. The panel 1362 and the touch panel 1352 may be integrated into a single module. The hologram device 1364 may display a stereoscopic image in a space using a light interference phenomenon. The projector 1366 may project light onto a screen so as to display an image. For example, the screen may be arranged inside of or outside of the electronic device 1301. The display 1360 may further include a control circuit for controlling the panel 1362, the hologram device 1364, or the projector 1366.

The interface 1370 may include, for example, an HDMI 1372, a USB 1374, an optical interface 1376, or a D-sub-miniature (D-sub) connector 1378. The interface 1370 may be included, for example, in the communication interface 1270 illustrated in FIG. 12. Additionally or generally, the interface 1370 may include, for example, a mobile high definition link (MHL) interface, an SD card/MMC interface, or an Infrared Data Association (IrDA) standard interface.

The audio module 1380 may convert a sound and an electrical signal in dual directions. At least a part of the audio module 1380 may be included, for example, in the input/output interface 1250 illustrated in FIG. 12. The audio module 1380 may process, for example, sound information that is input or output through a speaker 1382, a receiver 1384, an earphone 1386, or the microphone 1388.

The camera module 1391 may shoot a still image or a video. The camera module 1391 may include at least one or more image sensors (e.g., a front sensor or a rear sensor), a lens, an image signal processor (ISP), or a flash (e.g., an LED or a xenon lamp).

The power management module 1395 may manage, for example, power of the electronic device 1301. A power management integrated circuit (PMIC), a charger IC, or a battery gauge may be included in the power management module 1395. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, or a rectifier, and the like. The battery gauge may measure, for example, a remaining capacity of the battery 1396 and a voltage, current or temperature thereof while the battery is charged. The battery 1396 may include, for example, a rechargeable battery and/or a solar battery.

The indicator 1397 may display a certain state of the electronic device 1301 or a part thereof (e.g., the processor 1310), such as a booting state, a message state, a charging state, and the like. The motor 1398 may convert an electrical signal into a mechanical vibration and may generate the following effects: vibration, haptic, and the like. A processing device (e.g., a GPU) for supporting a mobile TV may be included in the electronic device 1301. The processing device for supporting the mobile TV may process media data according to the standards of digital multimedia broadcasting (DMB), digital video broadcasting (DVB), MediaFlo™, or the like.

Each of the above-mentioned elements of the electronic device according to various embodiments of the present disclosure may be configured with one or more components, and the names of the elements may be changed according to the type of the electronic device. The electronic device may include at least one of the above-mentioned elements, and some elements may be omitted or other additional elements may be added. Furthermore, some of the elements of the electronic device may be combined with each other so as to form one entity, so that the functions of the elements may be performed in the same manner as before the combination.

Figure 14:
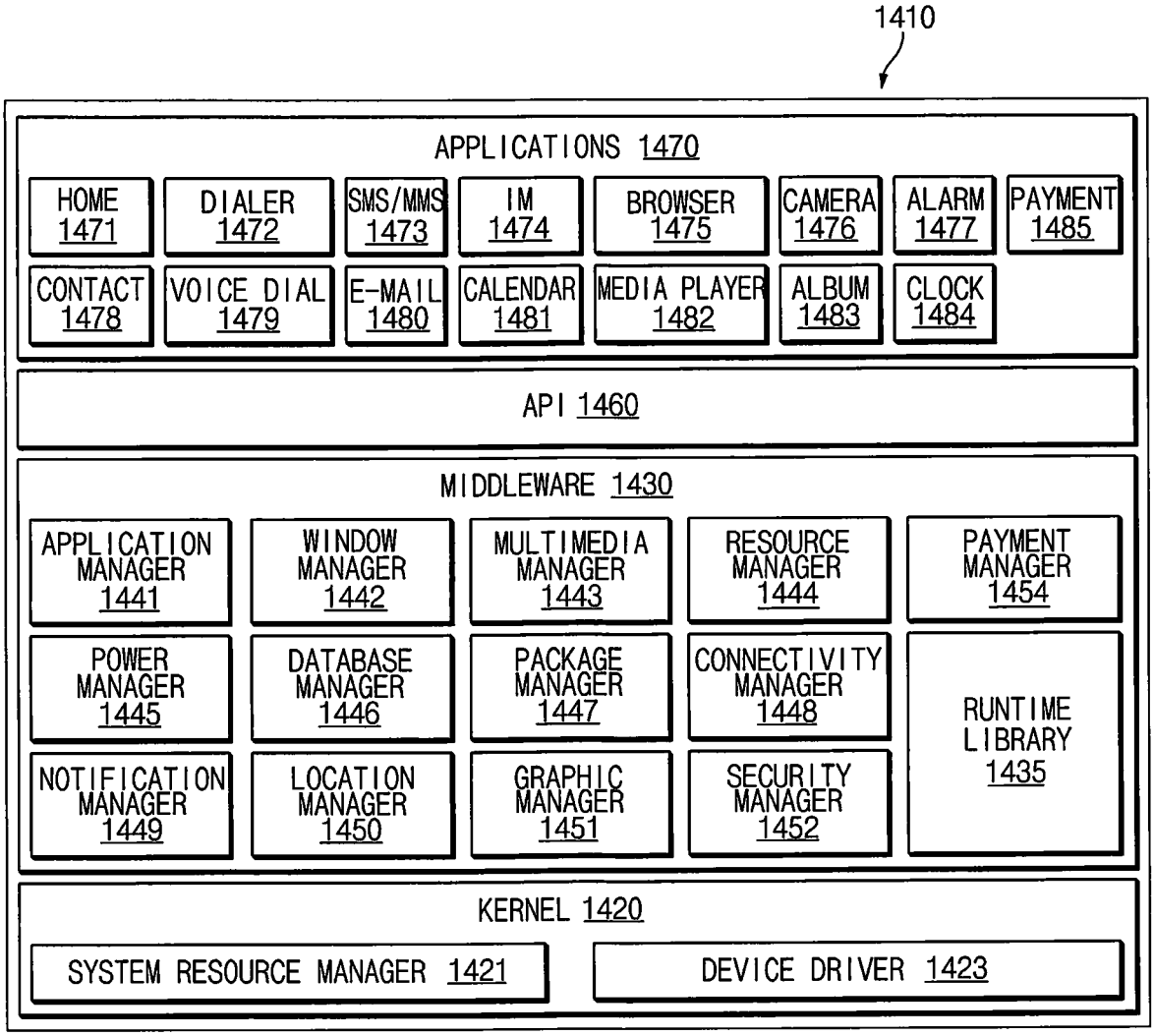
FIG. 14 illustrates a block diagram of a program module, according to an embodiment of the present disclosure.

FIG. 14 illustrates a block diagram of a program module, according to an embodiment of the present disclosure.

A program module 1410 (e.g., the program 1240) may include an OS to control resources associated with an electronic device (e.g., the electronic device 1201), and/or diverse applications (e.g., the application program 1247) driven on the OS. The OS may be, for example, Android®, iOS®, Windows®, Symbian®, Tizen®, or Bada™.

The program module 1410 may include a kernel 1420, a middleware 1430, an API 1460, and/or applications (or an application) 1470. At least a portion of the program module 1410 may be preloaded on an electronic device or may be downloadable from an external electronic device (e.g., the electronic device 1202 or 1204, the server 1206, or the like).

The kernel 1420 (e.g., the kernel 1241) may include, for example, a system resource manager 1421 or a device driver 1423. The system resource manager 1421 may perform control, allocation, or retrieval of system resources. The system resource manager 1421 may include a process managing unit, a memory managing unit, or a file system managing unit. The device driver 1423 may include, for example, a display driver, a camera driver, a Bluetooth driver, a shared memory driver, a USB driver, a keypad driver, a Wi-Fi driver, an audio driver, or an inter-process communication (IPC) driver.

The middleware 1430 may provide, for example, a function that the application 1470 needs in common, or may provide diverse functions to the application 1470 through the API 1460 to allow the application 1470 to efficiently use limited system resources of the electronic device. The middleware 1430 (e.g., the middleware 1243) may include at least one of a runtime library 1435, an application manager 1441, a window manager 1442, a multimedia manager 1443, a resource manager 1444, a power manager 1445, a database manager 1446, a package manager 1447, a connectivity manager 1448, a notification manager 1449, a location manager 1450, a graphic manager 1451, a security manager 1452, or a payment manager 1454.

The runtime library 1435 may include, for example, a library module that is used by a compiler to add a new function through a programming language while the application 1470 is being executed. The runtime library 1435 may perform input/output management, memory management, or capacities about arithmetic functions.

The application manager 1441 may manage, for example, a life cycle of at least one application of the application 1470. The window manager 1442 may manage a graphical user interface (GUI) resource that is used in a screen. The multimedia manager 1443 may identify a format necessary for playing diverse media files, and may perform encoding or decoding of media files by using a codec suitable for the format. The resource manager 1444 may manage resources such as a storage space, memory, or source code of at least one application of the application 1470.

The power manager 1445 may operate, for example, with a basic input/output system (BIOS) to manage a battery or power, and may provide power information for an operation of an electronic device. The database manager 1446 may generate, search for, or modify a database that is to be used in at least one application of the application 1470. The package manager 1447 may install or update an application that is distributed in the form of a package file.

The connectivity manager 1448 may manage, for example, a wireless connection such as Wi-Fi or Bluetooth. The notification manager 1449 may display or notify an event such as an arrival message, an appointment, or a proximity notification in a mode that does not disturb a user. The location manager 1450 may manage location information about an electronic device. The graphic manager 1451 may manage a graphic effect that is provided to a user, or manage a user interface relevant thereto. The security manager 1452 may provide a general security function necessary for system security, user authentication, or the like. In a case where an electronic device (e.g., the electronic device 1201) includes a telephony function, the middleware 1430 may further include a telephony manager for managing a voice or video call function of the electronic device.

The middleware 1430 may include a middleware module that combines diverse functions of the above-described elements. The middleware 1430 may provide a module specialized to each OS type to provide differentiated functions. Additionally, the middleware 1430 may dynamically remove a part of the preexisting elements or may add new elements thereto.

The API 1460 (e.g., the API 1245) may be, for example, a set of programming functions and may be provided with a configuration that is variable depending on an OS. For example, in the case where an OS is the Android® or the iOS®, it may provide one API set per platform. In the case where an OS is Tizen®, it may provide two or more API sets per platform.

The application 1470 (e.g., the application program 1247) may include, for example, one or more applications capable of providing functions for a home application 1471, a dialer application 1472, an SMS/MMS application 1473, an instant message (IM) application 1474, a browser application 1475, a camera application 1476, an alarm application 1477, a contact application 1478, a voice dial application 1479, an e-mail application 1480, a calendar application 1481, a media player application 1482, an album application 1483, a clock application 1484, a payment application 1485, a health care application (e.g., an application for measuring a quantity of exercise, a blood sugar level, or the like) or an environmental information application (e.g., an application for providing information concerning barometric pressure, humidity, temperature, or the like).

According to an embodiment of the present disclosure, the application 1470 may include an application (information exchanging application) to support information exchange between an electronic device (e.g., the electronic device 1201) and an external electronic device (e.g., the electronic device 1202 or 1204). The information exchanging application may include, for example, a notification relay application for transmitting certain information to an external electronic device, or a device management application for managing the external electronic device.

For example, the notification relay application may include a function for transmitting notification information, which arise from other applications (e.g., applications for SMS/MMS, e-mail, health care, or environmental information), to an external electronic device (e.g., the electronic device 1202 or 1204). Additionally, the information exchanging application may receive, for example, notification information from an external electronic device and provide the notification information to a user.

The device management application may manage (e.g., install, delete, or update), for example, at least one function (e.g., turn-on/turn-off an external electronic device (or a part of elements) or adjustment of brightness (or resolution) of a display) of the external electronic device which communicates with the electronic device, an application running in the external electronic device, or a service (e.g., a call service, a message service, or the like) provided from the external electronic device.

According to an embodiment of the present disclosure, the application 1470 may include an application (e.g., a health care application of a mobile medical device) that is assigned in accordance with an attribute of an external electronic device (e.g., the electronic device 1202 or 1204). The application 1470 may include an application that is received from an external electronic device (e.g., the electronic device 1202 or 1204, or the server 1206). The application 1470 may include a preloaded application or a third party application that is downloadable from a server. The names of elements of the program module 1410 according to an embodiment of the present disclosure may be modifiable depending on the type of OS.

According to various embodiments of the present disclosure, at least a portion of the program module 1410 may be implemented by software, firmware, hardware, or a combination of two or more thereof. At least a portion of the program module 1410 may be implemented (e.g., executed), for example, by the processor (e.g., the processor 1310). At least a portion of the program module 1410 may include, for example, modules, programs, routines, sets of instructions, processes, or the like for performing one or more functions.

The term "module" used in the present disclosure may represent, for example, a unit including one or more combinations of hardware, software and firmware. The term "module" may be interchangeably used with the terms "unit", "logic", "logical block", "component" and "circuit". The term "module" may indicate a minimum unit of an integrated component or may be a part thereof. The term "module" may indicate a minimum unit for performing one or more functions or a part thereof. The term "module" may indicate a device implemented mechanically or electronically. For example, the term "module" may include at least one of an application-specific IC (ASIC), a field-programmable gate array (FPGA), and a programmable-logic device for performing some operations, which are known or will be developed.

At least a part of an apparatus (e.g., modules or functions thereof) or a method (e.g., operations) according to various embodiments of the present disclosure may be, for example, implemented by instructions stored in a non-transitory computer-readable recording medium in the form of a program module. The instruction, when executed by a processor (e.g., the processor 1220), may cause the one or more processors to perform a function corresponding to the instruction. The non-transitory computer-readable recording medium, for example, may be the memory 1230.

A non-transitory computer-readable recording medium may include a hard disk, a floppy disk, a magnetic medium (e.g., a magnetic tape), an optical medium (e.g., a compact disc read only memory (CD-ROM) and a digital versatile disc (DVD), a magneto-optical media (e.g., a floptical disk)), and hardware devices (e.g., a read only memory (ROM), a random access memory (RAM), or a flash memory). In addition, a program instruction may include not only a mechanical code such as things generated by a compiler but also a high-level language code executable on a computer using an interpreter. The above hardware unit may be configured to operate via one or more software modules for performing an operation of various embodiments of the present disclosure, and vice versa.

A module or a program module according to various embodiments of the present disclosure may include at least one of the above elements, a part of the above elements may be omitted, or additional elements may be further included. Operations performed by a module, a program module, or other elements according to various embodiments of the present disclosure may be executed sequentially, in parallel, repeatedly, or in a heuristic method. In addition, some operations may be executed in different sequences or may be omitted. Alternatively, other operations may be added.

According to embodiments of the present disclosure, it may be possible to provide an electronic device that smoothly performs communication with a vehicle in cases where influence of an external object exists and where the influence of the external object does not exist, by using a plurality of antenna radiators.

While the present disclosure has been shown and described with reference to various embodiments thereof, it will be understood by those skilled in the art that various changes in form and details may be made therein without departing from the scope of the present disclosure as defined by the appended claims and their equivalents.

What is claimed is:

1. An electronic device which controls a vehicle wirelessly, comprising:

a housing;

a first antenna radiator configured to transmit a signal having a target frequency to the vehicle and exposed to an outside of the housing;

a second antenna radiator spaced apart from the first antenna radiator, configured to transmit the signal having the target frequency to the vehicle, and exposed to the outside of the housing;

a conductive line disposed in an interior of the housing and electrically connecting the first antenna radiator and the second antenna radiator; and a feeding part configured to supply power to one point of the conductive line, wherein a first electrical length formed by the feeding part, the one point of the conductive line, and the first antenna radiator is different from a second electrical length formed by the feeding part, the one point of the conductive line, and the second antenna radiator, wherein if the first antenna radiator does not make contact with the external object, a first band that is a frequency band supported by the first antenna radiator includes the target frequency, and wherein, if the second antenna radiator makes contact with an external object, a second band that is a frequency band supported by the second antenna radiator includes the target frequency.

2. The electronic device of claim 1, wherein if the electronic device is gripped by a hand of a user, the second band includes the target frequency.

3. The electronic device of claim 1, wherein each of the first antenna radiator and the second antenna radiator includes a metal frame exposed to an outside of the housing.

4. The electronic device of claim 1, wherein the first antenna radiator and the second antenna radiator have a same shape.

5. The electronic device of claim 1, further comprising:

a first connection member electrically connecting the conductive line and the first antenna radiator; and a second connection member electrically connecting the conductive line and the second antenna radiator, wherein the first connection member and the second connection member are electrically connected to the first antenna radiator and the second antenna radiator through one or more openings formed in the housing, respectively.

6. The electronic device of claim 1, further comprising:

an element interposed between the one point of the conductive line and the second antenna radiator and configured to adjust the second electrical length.

7. The electronic device of claim 1, wherein the target frequency is about 300 MHz to about 450 MHz.

8. The electronic device of claim 1, wherein the electronic device is a key for using the vehicle.

9. An electronic device, comprising:

a first antenna radiator;

a second antenna radiator spaced apart from the first antenna radiator;

a conductive line electrically connecting the first antenna radiator and the second antenna radiator; and a feeding part configured to supply power to one point of the conductive line, wherein a first electrical length formed by the feeding part, the one point of the conductive line, and the first antenna radiator is different from a second electrical length formed by the feeding part, the one point of the conductive line, and the second antenna radiator, wherein, if the first antenna radiator is not contacting an external object, a first band that is a frequency band supported by the first antenna radiator includes a target frequency for controlling a vehicle, and wherein, if the second antenna radiator makes contact with an external object, a second band that is a frequency band supported by the second antenna radiator includes the target frequency.

* * * * *